US006634128B1

(12) United States Patent
Vastag

(10) Patent No.: US 6,634,128 B1
(45) Date of Patent: Oct. 21, 2003

(54) 0.22 CALIBER LONG RIFLE REMOVABLE CONVERSION SYSTEM KIT FOR BLACK POWDER CAP AND BALL REPRODUCTION AND REPLICA REVOLVER—RECREATION AND GALLERY SHOOTING

(76) Inventor: Laszlo Vastag, Rd. 1, Box 135A, Stamford, NY (US) 12167

( * ) Notice: Subject to any disclaimer, the term of this patent is extended or adjusted under 35 U.S.C. 154(b) by 120 days.

(21) Appl. No.: 09/815,173

(22) Filed: Mar. 23, 2001

Related U.S. Application Data

(63) Continuation-in-part of application No. 09/679,486, filed on Oct. 4, 2000.

(51) Int. Cl.[7] ..... F41C 3/14

(52) U.S. Cl. ..... 42/59; 42/65; 42/77; 89/29; 89/27.14

(58) Field of Search ..... 42/59, 77, 65; 89/29, 27.11, 27.14, 27.13

(56) References Cited

U.S. PATENT DOCUMENTS 3,543,429 A * 12/1970 Bendele et al. ..... 42/77
4,459,774 A * 7/1984 Ferretti ..... 42/77
4,735,009 A * 4/1988 Jett, Jr. ..... 42/77
5,729,927 A * 3/1998 Shaver, Jr. ..... 42/77
6,029,385 A * 2/2000 Howell, Jr. ..... 42/59
6,047,490 A * 4/2000 Kirst ..... 42/59

* cited by examiner

*Primary Examiner*—J. Woodrow Eldred
(74) *Attorney, Agent, or Firm*—Edward P. Dutkiewicz

(57) ABSTRACT

A 0.22 caliber long rifle removable conversion system kit for open top frame, black powder, ball and cap colt reproduction and replica revolver—recreation and gallery shooting comprises a barrel nut and a barrel sleeve nut being threaded to mate with a threaded portion of the outside diameter of the barrel sleeve and sized to fit snugly into the inside diameter of the outlet of the pistol barrel. Also included is a firing pin ring assembly comprised of a loading gate subassembly, firing pin subassembly and firing pin ring. Also included is a cartridge cylinder being cylindrical in shape with cartridge apertures configured to mate with and engage the existing rotation hand and locking lug of the pistol frame. Lastly included is a barrel wedge assembly comprising an expanding wedge subassembly and an unloading rod assembly comprising an unloading rod and an unloading rod housing.

12 Claims, 17 Drawing Sheets

FIG 1
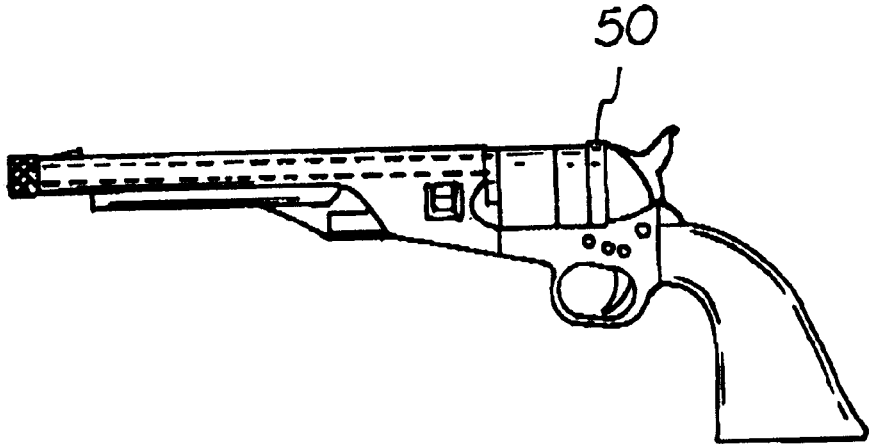
FIG 1A
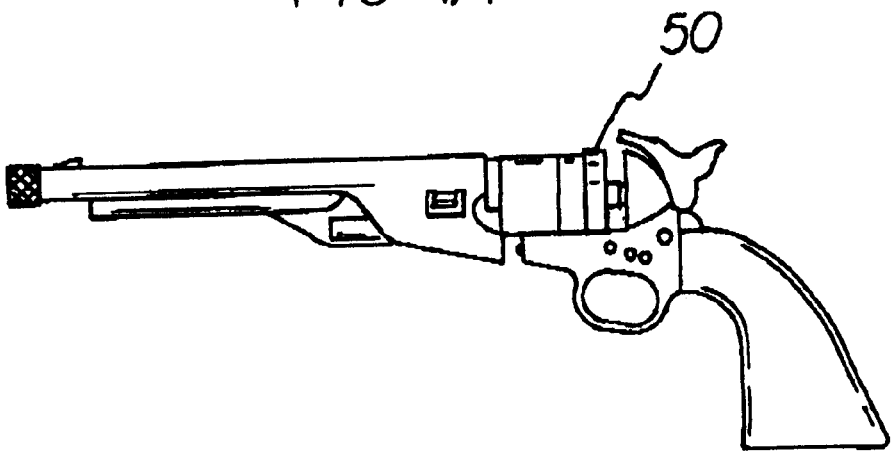
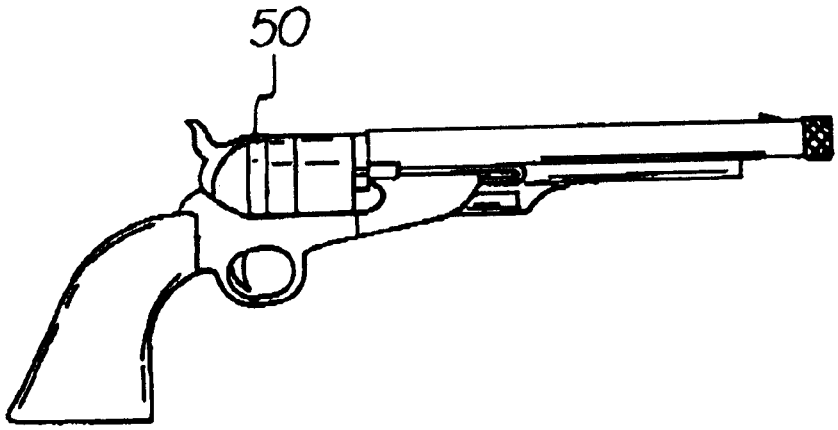
FIG 2

101
68
78
76
50
100
94
98
96
30
32
20
28
26
19A
104
404
406
106
102
108
114
46
44
48
42
118
116
120
122
130
130A
126
128
132
134
134A
134B
134C
3

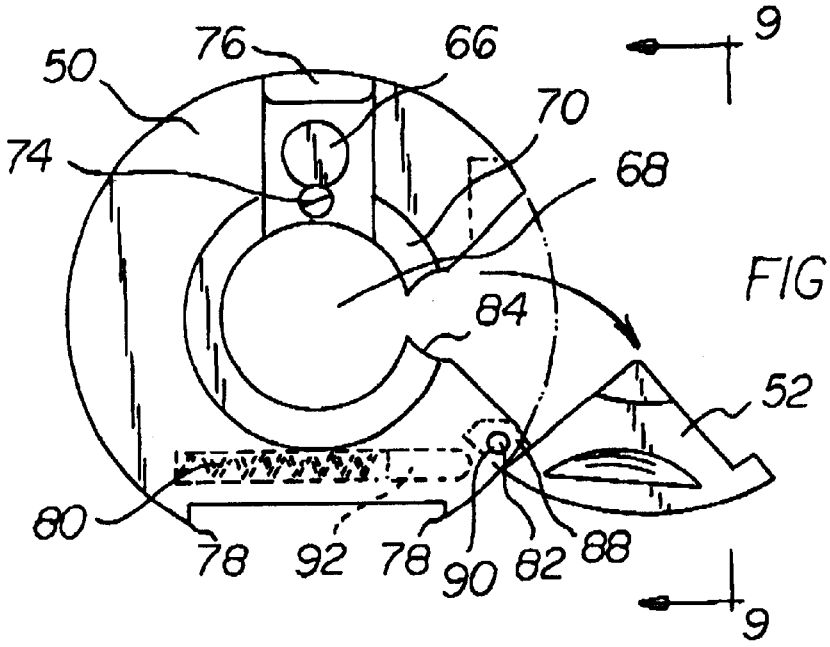
FIG 8
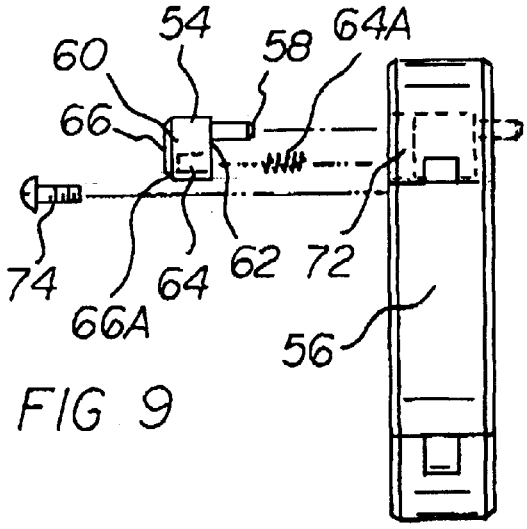
FIG 9
FIG 8A
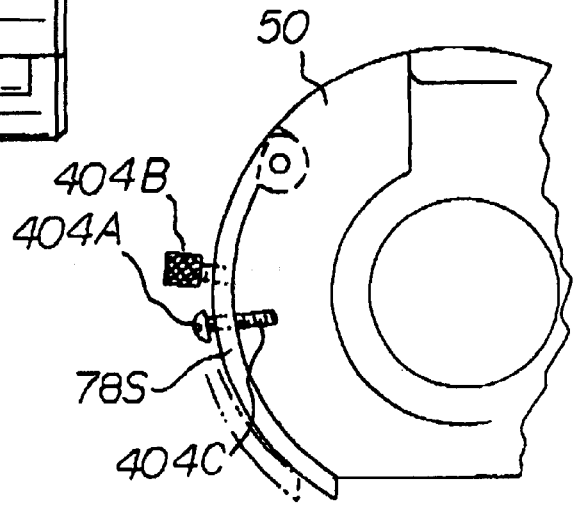

FIG 13A
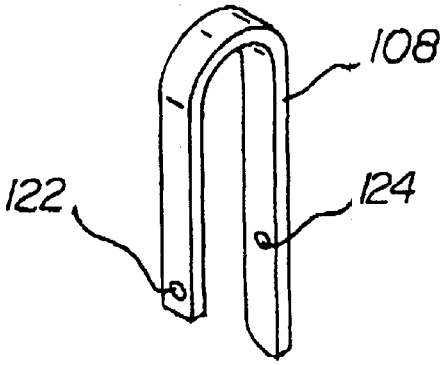
FIG 13B
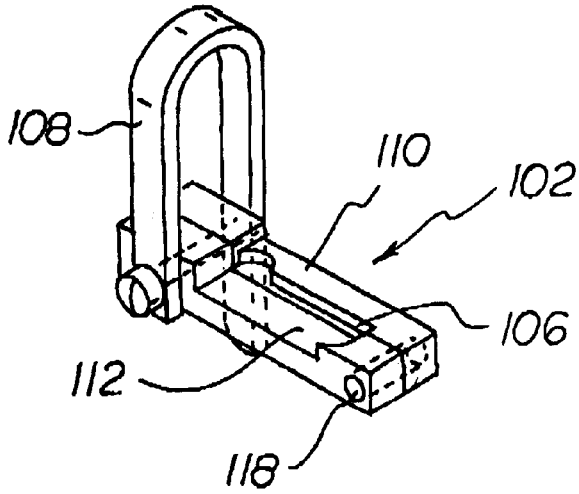
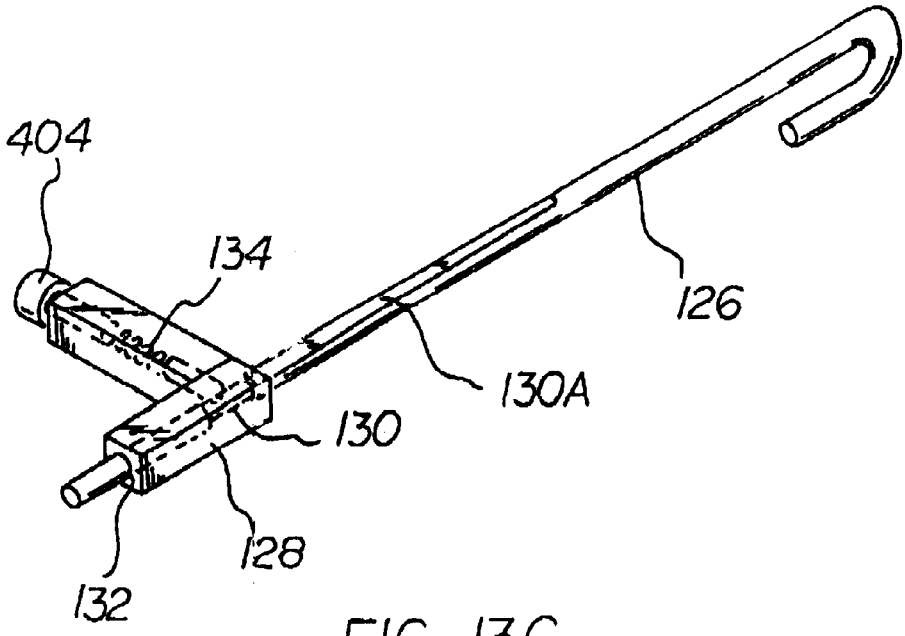
FIG 13C

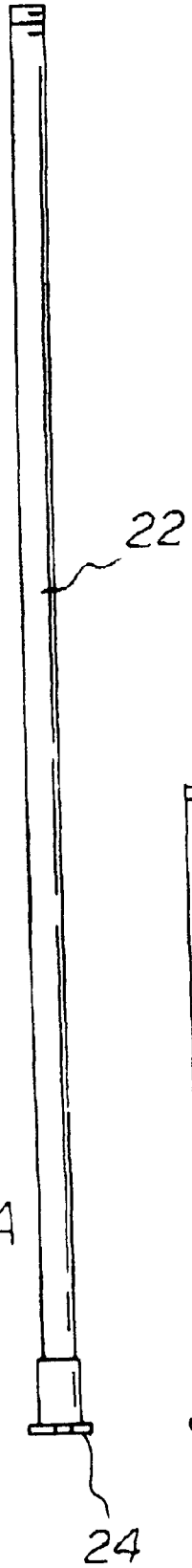
FIG 15A
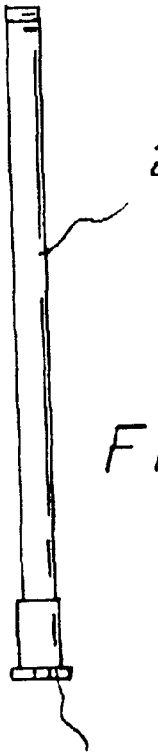
FIG 15
FIG 16
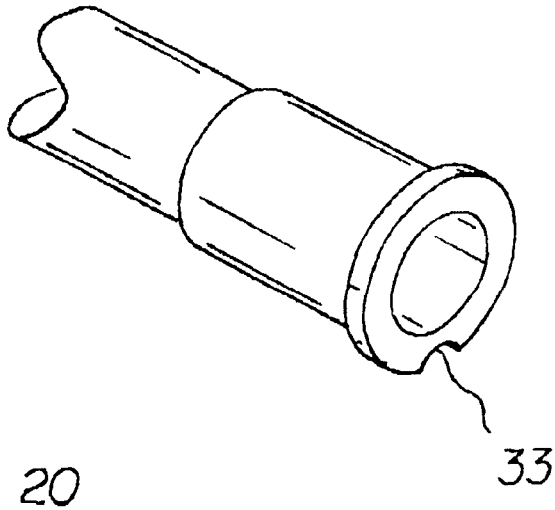

FIG 19
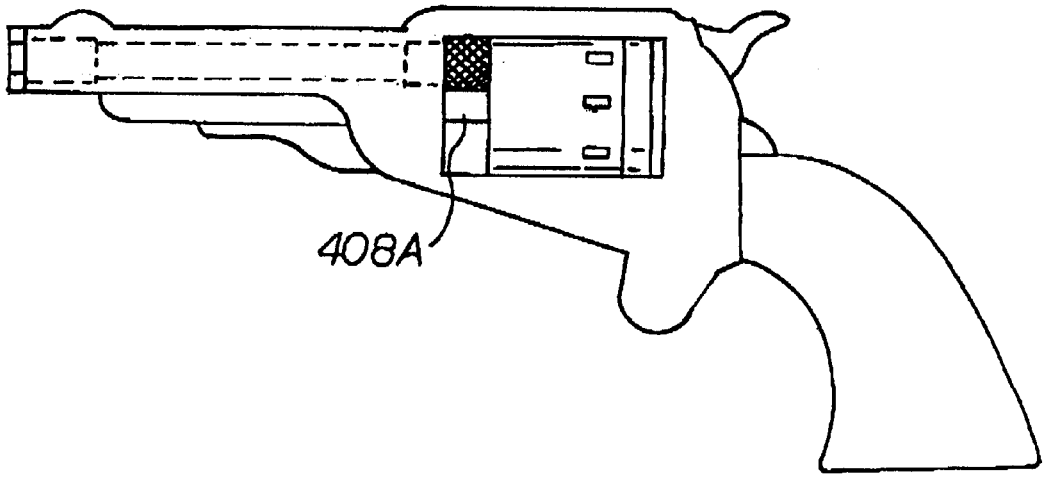
FIG 20
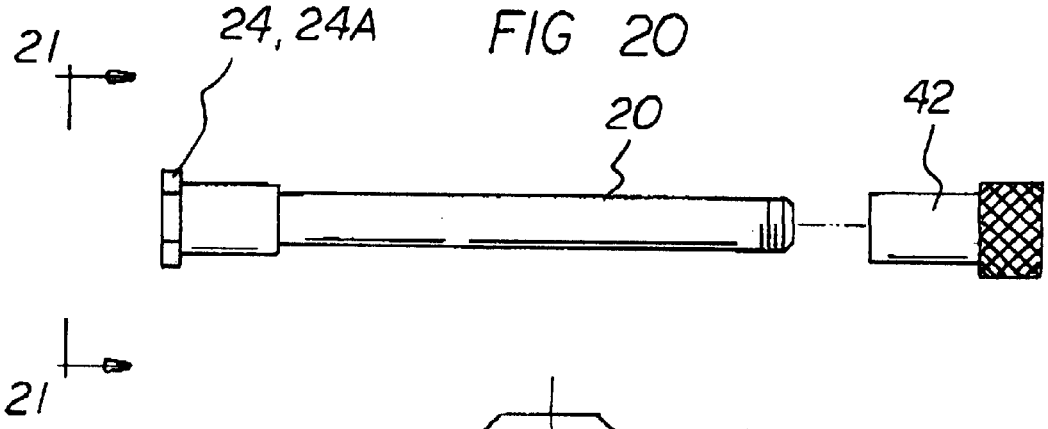
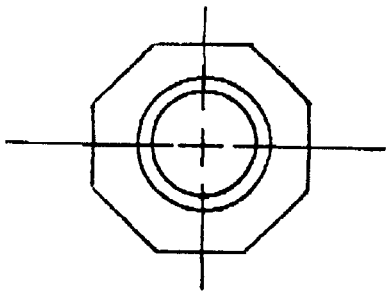
FIG 21

FIG 26
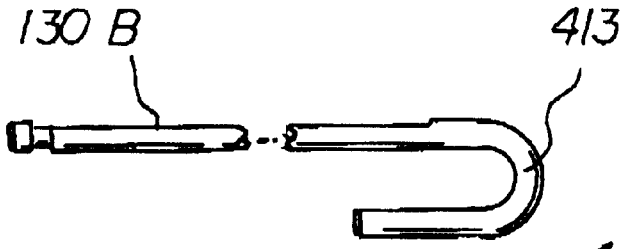
FIG 26A
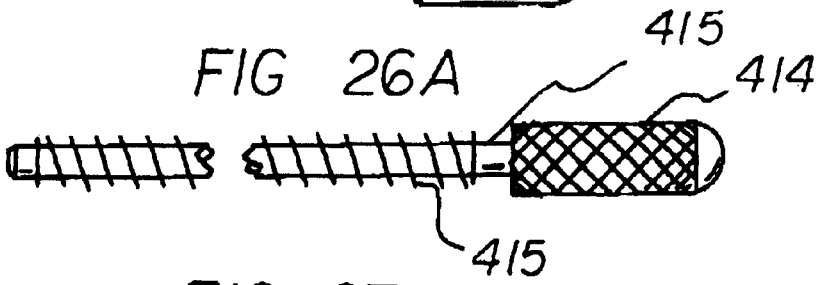
FIG 27
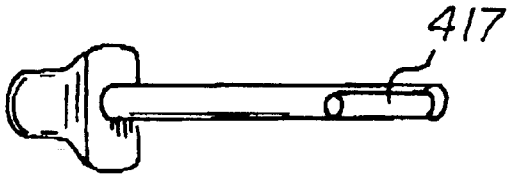
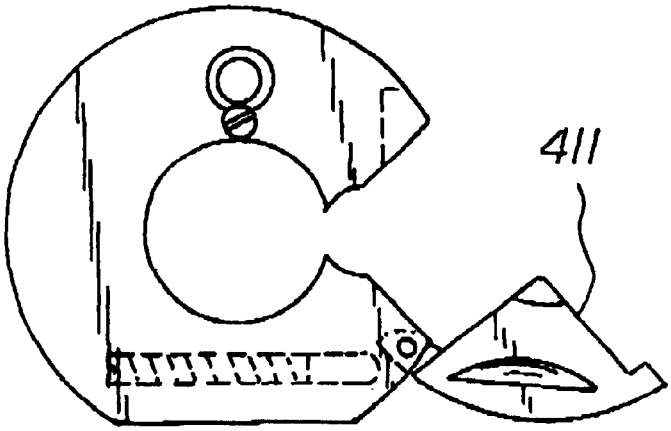
FIG 28

0.22 CALIBER LONG RIFLE REMOVABLE CONVERSION SYSTEM KIT FOR BLACK POWDER CAP AND BALL REPRODUCTION AND REPLICA REVOLVER— RECREATION AND GALLERY SHOOTING

RELATED APPLICATION

This is a continuation-in-part of co-pending application Ser. No. 09/679,486 filed Oct. 4, 2000, the subject matter of which is incorporated herein by reference.

BACKGROUND OF THE INVENTION

1. Field of the Invention

The present invention relates to a 0.22 caliber long rifle removable conversion system kit for black powder, ball and cap reproduction and replica revolver—recreation and gallery shooting and more particularly pertains to a system for safely and conveniently converting a black powder pistol to fire modern smaller caliber cartridges and back again.

2. Description of the Prior Art

The use of known methods and apparatuses for converting black powder pistols to fire modern ammunition of a smaller caliber is known in the prior art. More specifically, known methods and apparatuses for converting black powder pistols to fire modern ammunition of a smaller caliber previously devised and utilized for the purpose of allowing different ammunition to be used in ancient weapons are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,437,249 to Brown et al., Issued on Mar. 20, 1984 discloses a steel plug to convert a modern shotguns to function as a muzzle loading weapon. U.S. Pat. No. 4,882,997 to Baxter et al., Issued Nov. 28, 1989 discloses a projectile to be used in firearms training. Lastly, U.S. Pat. No. 5,755,053 to Oakley, Issued May 26, 1998 discloses a plug to be used to convert a modern shotgun to fire as a muzzle loading weapon.

While these devices fulfill their respective, particular objectives and requirements, the aforementioned patents do not describe conversion system for converting a black powder, ball and cap pistol having a barrel and frame that allows for safely and conveniently allows the pistol to fire modern cartridges.

In this respect, the conversion system for converting a black powder, ball and cap pistol having a barrel and frame, to fire a modern cartridge of a smaller caliber according to the present invention substantially departs from the conventional concepts and designs of the prior art, and in doing so provides an apparatus primarily developed for the purpose of for safely and conveniently converting a black powder pistol to fire modern cartridges. If desired by the shooter, the gun to be converted quickly and easily to it's original black powder state to fire ball and black powder.

Therefore, it can be appreciated that there exists a continuing need for a new and improved conversion system for converting a black powder, ball and cap pistol having a barrel and frame, to fire a modern cartridge of a smaller caliber which can be used for safely and conveniently firing modern cartridges in a weapon of this type. In this regard, the present invention substantially fulfills this need.

SUMMARY OF THE INVENTION

In view of the foregoing disadvantages inherent in the known types of known methods and apparatuses for converting black powder pistols to fire modern ammunition of a smaller caliber now present in the prior art, the present invention provides an improved conversion system for converting a black powder, ball and cap pistol having a barrel and frame, to fire modern ammunition of a smaller caliber. As such, the general purpose of the present invention, which will be described subsequently in greater detail, is to provide a new and improved conversion system for converting a black powder, ball and cap pistol having a barrel and frame, to fire a modern cartridge of a smaller caliber and a method which has all the advantages of the prior art and none of the disadvantages.

To attain this, the present invention essentially comprises a conversion system for converting a black powder, ball and cap pistol having a barrel and frame, to fire a modern cartridge of a smaller caliber. This system comprises a barrel sleeve and two barrel tubular sleeves, known as barrel sleeves, one being shorter and one being longer. The shorter barrel sleeve is between about 6 and 8 inches long and the longer barrel sleeve is between about 14 and 18 inches long. Each comprised of a hard material, such as metal and the short barrel sleeve has an inlet, an outlet, a connecting barrel, an inside diameter, an outside diameter and a central aperture which is continuous throughout the barrel sleeves between the ends. The outside diameter of the shorter barrel sleeve has a threaded outlet and connecting barrel sized to fit loosely within the barrel of a black powder pistol. The outside diameter is between about 0.36 and 0.46 of an inch. The inlet is configured in a flange-like shape. The flange has a smaller and larger component. The smaller component has a cylinder-like shape which is sized to fit snugly into the inside diameter of the inlet of the pistol barrel and has a plurality of raised dimples which are sized to fit tightly into the inlet of the barrel rifling of the pistol. The large portion of the inlet is disc shaped with the disc being perpendicular to the smaller component of the inlet and it forms a flange lip having a central aperture with an inside diameter of between about 0.17 and 0.25 of an inch consistent with the barrel inside diameter. The longer barrel sleeve is configured as the shorter barrel sleeve and is longer. The outlet of the long barrel nut is further configured with a tapered outlet end, with the outside thread being made to accommodate a ⅜–18 pipe tapered nut. There are four letting slits between about 0.50 and 1.0 inch in length from the outlet end, inward, and four letting apertures having a diameter of between about 0.10 and 0.20 of an inch which are drilled at 90 degree angles to each other about a circumferential line at the location of the inboard extreme of the letting slits. These apertures are approximately 1.0 inch from the outlet of the barrel extension. The short barrel sleeve is secured with a barrel sleeve nut which comprises an inlet, an outlet and a portion therein between. It is preferably made of hard metal, and has a uniform central aperture. One configuration of the nut can have a stepped cylindrical configuration. The inlet is round and the outside diameter is sized to fit within the inside diameter of a pistol barrel. It has a length of between about 0.5 and 1.0 inch. The inlet is female threaded on the inside diameter of its aperture and threaded to mate with the male threaded portion of the threaded outside diameter of the barrel sleeve. The outside diameter of the inlet is sized to fit snugly into the inside diameter of the outlet of the pistol barrel. The outlet portion of the barrel nut is larger, approximating the outside diameter of the pistol barrel which is between about 0.5 and 1.0 inch in diameter. The barrel nut has a knurled surface for positive grip of the larger outlet portion. The long barrel sleeve nut is locked with a locking nut is one in which the nut has a tapered internal thread in the inlet so as to allow slight compression of the barrel extension outlet by the nut as it is tightened. The nut has a round cylindrical configuration with the interior diameter of the inlet being round and tapered inwardly. The nut has a length of between about 0.5 and 1.0 inch with the inlet being female threaded and tapered on the inside diameter of the aperture to mate with the tapered threaded portion of the threaded outside diameter of the barrel sleeve. The outside diameter of the nut is larger than the outside diameter of the existing pistol barrel and has a length of between about 0.5 and 1.0 inch. There is a firing pin ring assembly, having a doughnut-like shape, comprised of a loading gate subassembly, a firing pin subassembly and a firing pin ring. The firing pin subassembly has an inboard and outboard component. The inboard component comprises a solid cylinder having an inboard and outboard portion. The inboard portion is cylindrically round with a flat striking end and the outboard portion is threaded. The overall diameter of the inboard component is between about 0.01 to 0.15 of an inch, preferably 3/32 of an inch and has a length of between about 0.10 and 0.33 of an inch. The outboard component of the firing pin subassembly, having an inboard and an outboard portion is a solid cylinder with an outside diameter of between about 0.01 and 0.30 of an inch, preferably 7/32 of an inch. On the inboard portion it has a threaded aperture to receive the end of the outboard portion of the inboard component of the firing pin subassembly. There is a spring nest on the inboard side, below the firing pin threaded aperture. In this apertures nests the firing pin return spring. The outboard portion has a flat-ended, cylindrical-shaped outboard hammer striking portion. The firing pin ring has an inboard and outboard face and a generally cylindrical configuration. It is between about 0.25 and 0.50 of an inch in thickness and has a diameter of between about 1.25 and 2.0 inches. There is a central aperture between about 0.40 and 0.80 of an inch in diameter, which passes through the ring from inboard to outboard. There is a recess surrounding the central aperture which is between about 0.10 and 0.20 of an inch in depth and between about 0.8 and 1.0 inch in diameter. A firing pin subassembly aperture passes through the ring, in which the firing pin subassembly is housed. A subassembly locking screw aperture is located just below and tangent to the firing pin subassembly aperture. A locking screw is threaded into the subassembly locking screw aperture and holds the firing pin subassembly in position. There is a stepped cylinder groove at the upward most edge of the firing ring perpendicular to the outboard face. The groove is located above the firing pin subassembly aperture. The groove begins at the outboard edge of the ring and has a depth of between about 0.25 and 0.35 of an inch. The step is located at between about 0.12 and 0.20 of in inch from the outboard edge of the firing ring. The step is placed approximately midpoint of the groove. It is wide enough to accommodate the width of the existing pistol hammer. The lower quadrant cylinder surface of between about 60 and 90 degrees of the circumference is a flat. The flattened area is opposite the firing pin subassembly aperture on the lower surface of the cylinder. It is configured to receive the frame of the pistol. The flattened area indents into the firing pin ring forming retention points which function to retain the firing pin ring in position and prevent rotation of the ring about the central shaft of the frame of the pistol when the gun's cylinder is rotated by the gun's rotating hand. A loading gate locking pin nest is drilled into the ring above and parallel with the flattened surface of the lower firing pin ring allowing the insertion of a spring and loading gate locking pin. A loading gate pivot aperture is drilled in an inboard direction from the outboard surface of the firing ring above the locking pin nest and runs perpendicular to the outboard surface. The continuity of the firing pin ring is interrupted and opened by a wedge-shaped cut which is a congruously-shaped to allow the close fit of a loading gate subassembly. There is a radius cut in the innermost aspect of the wedge cut in the firing ring to allow the passage of modern cartridge into the cylinder. The loading gate subassembly comprises a loading gate with an attachment tab, loading gate pivot pin and gate locking pin. This subassembly is mated to the opening in the ring and is attached by the loading gate pivot pin to the firing pin ring. The gate locking pin is nested in the body of the firing pin ring within an aperture which is drilled parallel with the lower flattened area, perpendicular to the central shaft aperture and is held in place by the loading gate tab. This allows the rotation of the loading gate about 90 degrees around the pivot pin, with the locking pin capable of retaining the gate in an open or closed position. A cartridge cylinder having the length of between about 1 and 2 inches, and a diameter of between about 1.5 and 2.5 inches is used in the system. The cartridge cylinder has an inboard and outboard surface, is cylindrical in shape with semi-circular locking lug depressions on the long outside wall of the cylinder, and has cartridge apertures which run the length of the cylinder from inboard to outboard. These cartridge apertures are between about 0.20 and 0.25 of an inch in internal diameter and are positioned in a circular, circumferential orientation around the cylinder's central shaft aperture, which runs through the length of the cylinder. There is a cylindrical rotation ratchet on the outboard side of the cartridge cylinder. The ratchet is cylindrical in shape with a saw-toothed ridge on the outward, outboard edge. The teeth are configured to mate with and engage the existing rotation hand of the pistol frame. The ratchet fits through the central aperture of the firing pin ring and engages the pistol frame mechanism. The locking lug depressions on the outside long surface of the cylinder mate with and engage the existing pistol locking bolt of the pistol frame. A barrel wedge assembly comprises a wedge subassembly and an unloading rod assembly. The barrel wedge subassembly has an over all thickness being between about 0.15 and 0.30 inches in width. It comprises an expanding wedge portion and a extraction portion. The expanding wedge portion is two strips of rigid material, positioned side by side with the rearward metal strip being indented to accept the wedge screw. The wedge screw is threadedly attached to the existing pistol barrel and retains the wedge, preventing it from pulling from the wedge opening in the barrel of the existing revolver. There are two aligned apertures through the two pieces of the wedge. The attachment aperture is located on the outboard side. The rivet aperture is located on the inboard side. A third aperture, the distractor aperture, is located outboard of the attachment aperture. This aperture extends through only one metal strip. A distractor screw is threaded into the single unmatched aperture. It is used to mechanically separate the metal strips, spreading the strips and enlarging the horizontal width of the wedge. The rivet aperture is drilled smooth to receive a pin of between about 0.10 and 0.16 of an inch in outside diameter. The extraction portion of the barrel wedge subassembly is configured from a single strip of a rigid material, preferably metal. It is U shaped with an over all thickness being between about 0.15 and 0.30 inches in width. The extractor portion has two parallel sides with one being longer than the other and a perpendicular connecting cross member. The sides create an opening opposite of the cross member. A pivotal pin aperture sized to allow passage of a 6-32 cap head screw is made at the end of the shorter side. A pivotal aperture on the long side, which is threaded to receive a 6-32 cap head screw, is aligned with an identical pivotal aperture on the short side. These apertures are equidistant from the cross member of the subassembly and align with the attachment aperture of the wedge. The wedge is attached to the extraction portion of the barrel wedge by a 6-32 cap head screw which passes through the aperture in the short side of the extractor portion, then through both of the strips of the wedge, and into the threaded aperture in the long leg of the extractor portion of the wedge subassembly. An unloading rod assembly comprises an unloading rod and an unloading rod housing. The unloading rod has an inboard and outboard end, having an overall length of between about 2 and 4 inches long and between about 0.12 and 0.20 inches in diameter. It is made of rigid material, preferably of steel. It has its outboard end shaped in a U which has a radius of between about 0.10 and 0.30, the length of the U of the unloading rod being between about 0.50 and 0.90 inches in length. There is a circumferential groove of between about 260 and 280 degrees around the outside diameter of the unloading rod at about a distance of between about 0.50 and 1.0 inch from the inboard end. This partial groove leaves a smooth area of between about 80 and 100 degrees of the rod's circumferential surface between the ends of the groove. The unloading rod housing has an inboard and an outboard side, with an over all thickness being between about 0.15 and 0.30 inches in width. It is L shaped with the inboard leg of the L being longer than the outboard leg. The short outboard leg is oriented parallel with the center line of the bore of the revolver, in line with a lateral chamber of the revolver's cylinder. It has an aperture with the diameter of between about 0.145 and 0.165 of an inch through the length of the short leg, which allows the unloading rod to be housed within this aperture. The long leg of the L shaped unloading rod housing is oriented perpendicular to the center line of the revolver. It has an inboard and outboard portion. It has a through aperture of between about 0.09 and 0.12 of an inch in diameter communicating with and meeting with the short leg of the unloading rod housing. The inboard end of that aperture is threaded to the size of about a 5-40 screw. A spring and a pin are retained within the confines of the through aperture by this screw. The pin intersects the aperture of the housing. The aperture of the housing runs in a course perpendicular to the path of the pin. The pin and spring function as a holding pin to prevent inadvertent movement of the unloading rod. The long leg is positioned within the existing revolver wedge hole, just inboard and parallel to the expanding wedge. There is a skeleton pistol grip shoulder stock, comprising the components of a main stock wedge, a tubular rounded extension, an upward grip member, a connecting weld, a hook and nut, a horizontal grip member and a vertical cross grip member. The main stock wedge has an upper, lower, inboard and outboard component, being made of a rigid, light weight material, preferably a rigid tubular plastic or tubular metal of between about 0.36 and 0.75 of an inch in the outside diameter. The main stock wedge upper and lower components are almost equal in length and run at a converging angle of between about 5 and 20 degrees, with the wider distance between the upper and lower components being at the outboard extreme and the narrower distance being at the inboard extreme of the upper and lower components. Each of those components being between about 12 and 20 inches long. The outboard component is between about 4 and 6 inches long. It connects the upper and lower components and has a generally concave configuration. The shorter inboard component is between about 1 and 3 inches long and connects the innermost end of the upper component with a point on the lower component between about 1 and 2 inches from the innermost end of the lower component. This connection creates an angle of between about 75 and 90 degrees at the point of meeting with the lower component. The outermost end of the tubular rounded extension is a continuation of the lower component. It is about 1 and 2 inches long, having an inboard and outboard portion. The inboard portion has an aperture between about 0.20 and 0.30 of an inch through the tubular rounded extension which is angled at between about 60 and 85 degrees from the center line of the tubular rounded extension at a location of between about 0.25 and 0.50 of an inch from the innermost end. The upward grip member is constructed of an L shaped rigid material, preferably steel, having a short leg and a long leg. A weld securely couples the stock tubular rounded extension with the end of the long leg of the upward grip member, forming an angle of between about 60 and 85 degrees from the center line of the tubular rounded extension. The short leg is distant to the point of connection to the stock wedge and has the L bent in the general direction toward the stock wedge. This bend forms an approximately 90 degree angle bend with the lower longer portion of the L shape. There is an aperture being between about 0.20 and 0.30 of an inch in diameter in the short leg. The aperture is in line with the aperture in the tubular rounded extension. There is an upward grip hook of a generally solid cylindrical configuration. It is between about 3 and 6 inches long and has an outside diameter of between about 0.20 and 0.40 of an inch. It has an inboard and outboard component and a connecting shaft between. The outboard component is configured in a J hook shape. The hook comprises a bend in the shaft having a radius of between about 0.10 and 0.25 of an inch. The inboard end is threaded to a thread size of about 0.25 of an inch in outside diameter and the connecting shaft is between about 2 and 5 inches long. The upward grip hook nut has in inboard and outboard portion. The inboard portion is cylindrical with a threaded aperture to mate with the thread of the hook. The outside diameter of the inboard portion is between about 0.40 and 0.60 of an inch and is between about 0.30 and 0.50 of an inch in length. The outboard portion of the hook nut is a solid cylinder with a central aperture to continue the aperture through the inboard portion. The outside dimensions having a diameter of between about 0.60 and 0.80 of an inch and having a knurled surface on the outward rounded circumference. There is a flattened outermost end of the hook nut. A horizontal grip member having a generally elongated C configuration is made of a single piece of rigid material, preferably metal. It has a width of between about 0.25 and 0.40 of an inch. The horizontal grip member has two lateral components of between about 2 and 4 inches long and one central component of between about 1 and 2 inches long. Each lateral component has an aperture of between about 0.20 and 0.30 of an inch in diameter, and are equally spaced from the outboard open end of the C, that distance being between about 0.75 and 1.50 inches from the outboard open end of the C. A vertical cross grip member has a shortened C shaped configuration. It is comprised of a strip of between about 0.20 and 0.30 of an inch in width, of a rigid material, preferably metal. It has two short lateral components and one long central component. The short lateral components are between about 0.30 and 0.50 of an inch in length, with each having an equally spaced, centrally spaced aperture. The aperture has a diameter of between about 0.20 and 0.30 of an inch, so that it may be threaded to mate with the thread of a 0.25 inch machine screw. The vertical cross grip member is coupled with the horizontal grip member, preferably with the utilization of two machine screws. The entire skeleton pistol grip shoulder stock is attachable to the pistol. A scope mount is comprised of a single piece of rigid material, preferably steel. It is a square in width and height of between about 0.75 and 1.50 inches, with an overall rectangular length of between about 4 and 6 inches before machining. The scope mount plate is a rectangular piece of rigid material, preferably steel having a length of between about 1.0 and 1.8 inches and a width to slightly larger than the scope mount. The scope mount plate is between about 0.20 and 0.30 of an inch thick. The scope mount has an upper, lower and two side faces, with a attachment side and attachment end which mounts to the pistol and a scope side and scope end where the scope mounts. A horizontal step cut is made in the upper face of the scope side of the mount of between about 0.05 and 0.15 of an inch to a point approximately mid-length of the scope mount. The upper face also has a large aperture in the midline on the attachment side of the midpoint, being between about 0.40 and 0.60 of an inch in diameter through the midline. It is perpendicular to the upper face in the direction of the lower face. A slot of between about 0.20 and 0.30 of an inch in width connects the large aperture of the upper face with the end of the attachment side of the scope mount. The slot is cut through the entire height of the scope mount in the midline and extends to the end of the attachment side of the scope mount. A wide central slit is machined in the surface of the stepped scope side of the scope mount and is between about 0.05 and 0.10 of an inch in depth and between about 0.40 and 0.60 of an inch wide. It runs from the beginning of the step to the end of the scope side of the scope mount. There are six apertures in the central slit, being equally spaced between about 0.40 and 0.60 of an inch apart, center on center, centrally located on the midline of the scope mount length. These apertures threaded to fit a 6-32 machine thread screw. The side faces are notched inward and have an elongated Z configuration. Both legs of the Z are parallel. The central connector of the Z is short and obliquely angled inward making a narrowed upper faced portion of the scope mount on the scope end. The narrowing is between about 0.25 and 0.40 of an inch on each side the mount. One of the side faces has three apertures sized to accommodate the outside diameter of a 8-32 machine screw. The other side has four apertures, three of which align with and match the three apertures of the opposite side. These three apertures are sized so as to be threaded to a size which would mate with approximately an 8-32 machine screw. The tightening of these screws draws in and compresses the sides to one another and tightens the scope mount on the pistol. The fourth aperture which is located between the outboard two apertures of that side is threaded to a size to accommodate an 8-32 machine screw. There is no corresponding aperture on the opposite side, and this aperture with its screw functions as a spreader. It allows the insertion of the screw though the aperture to push against the opposite side. A letting aperture is drilled into the attachment side end face and has an aperture of between about 0.30 and 0.50 of an inch. It is drilled off of the center line so that the aperture interrupts the lower surface of the scope mount forming a radius slit from the scope side end to meet with and connect with the large aperture in the upper face of the scope side of the scope mount. The letting aperture allows the compression of the attachment side of the scope mount to tighten securely on the pistol barrel. The lower face of the scope mount has four apertures drilled toward the opposite side. There apertures are threaded to a diameter to accommodate a 6-32 machine screw. These apertures are perpendicular to the lower face, and are placed two on each side of the lower face between about 0.75 and 1.50 of an inch apart. The scope mount plate has an upper face and a lower face. The lower face being between about 1.0 and 2.0 inches in length with a width to be between about 0.50 and 0.80 of an inch wider than the width of the scope mount lower face. The plate is between about 0.220 and 0.30 of an inch in thickness and made of a rigid material, preferably steel. The plate has four apertures each having a diameter to allow passage of a 6-32 machine screw sized to match the four apertures of the lower face of the scope mount. A shallow full-length slit is machined in the upper face of the scope mount plate. This slit is between about 0.120 and 0.130 of an inch in depth and wide enough to accept the width of the scope mount. The full length slit is further machined along the entire length to have a radius curve of between about a 0.250 and 0.500 of an inch. This radius curve matches the radius curve of the lower face of the scope mount. The side walls created by the machining of the slit have a thickness of between about 0.25 and 0.40 of an inch.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved conversion system for converting a black powder, ball and cap pistol having a barrel and frame, to fire a modern cartridge of a smaller caliber which has all of the advantages of the prior art of the known methods and apparatuses for converting black powder pistols to fire modern ammunition of a smaller caliber and none of the disadvantages.

It is another object of the present invention to provide a new and improved conversion system for converting a black powder, ball and cap pistol having a barrel and frame, to fire a modern cartridge of a smaller caliber which may be easily and efficiently manufactured and marketed.

It is further object of the present invention to provide a new and improved conversion system for converting a black powder, ball and cap pistol having a barrel and frame, to fire a modern cartridge of a smaller caliber which is of durable and reliable constructions.

An even further object of the present invention is to provide a new and improved 0.22 caliber long rifle removable conversion system kit for open top frame, black powder, ball and cap colt reproduction and replica revolver—recreation and gallery shooting—having a barrel and frame, to fire a modern cartridge of a smaller caliber which is susceptible of a low cost of manufacture with regard to both materials and labor, and which accordingly is then susceptible of low prices of sale to the consuming public, thereby making such conversion system for converting a black powder, ball and cap pistol having a barrel and frame, to fire a modern cartridge of a smaller caliber economically available to the buying public.

Even still another object of the present invention is to provide a conversion system for safely and conveniently converting a black powder, ball and cap pistol having a barrel and frame, to fire a modern cartridge of a smaller caliber.

Lastly, it is an object of the present invention to provide a 0.22 caliber long rifle removable conversion system kit for open top frame, black powder, ball and cap colt reproduction and replica revolver—recreation and gallery shooting, comprising a barrel sleeve; a barrel sleeve nut being threaded to mate with a threaded portion of the outside diameter of the barrel sleeve and sized to fit snugly into the inside diameter of the outlet of the pistol barrel; a firing pin ring assembly comprised of a loading gate subassembly, firing pin subassembly and firing pin ring, a cartridge cylinder cylindrical in shape with cartridge apertures configured to mate with and engage the existing rotation hand and locking lug of the pistol frame; and a barrel wedge assembly comprising an expanding wedge subassembly and an unloading rod assembly comprising an unloading rod and an unloading rod housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevation from the left hand side of the pistol with the conversion system in place, reflecting part of the wedge combination with the lever in the vertical orientation.

FIG. 1A is a side elevation from the left hand side of the black powder pistol with the conversion system in place demonstrating the separation of the pistol frame and barrel.

FIG. 2 is a side elevation from the right hand side of the pistol with the conversion system in place, with barrel and frame joined reflecting the unloading rod.

FIG. 4 is an exploded elevation of the short barrel tubular sleeve and end nut.

FIG. 5 is a side elevation of the longer barrel tubular sleeve.

FIG. 6 is a side, exploded, elevation of the larger barrel nut and barrel locking nut.

FIG. 8 is a rear elevation of the firing ring, demonstrating the doughnut-like shape of the ring, and the loading gate.

FIG. 8A is a rear elevational view of a modified firing pin ring of an alternate design utilizing a curved flat spring steel.

FIG. 9 is a side exploded elevation of the firing ring, demonstrating the relationship of the firing ring and firing pin subassembly taken along line 9—9 of FIG. 8, with the drawing demonstrating the stepped groove on the upper aspect of the firing ring.

FIG. is a perspective view of the wedge assembly and unloading rod assembly.

Figure 13:
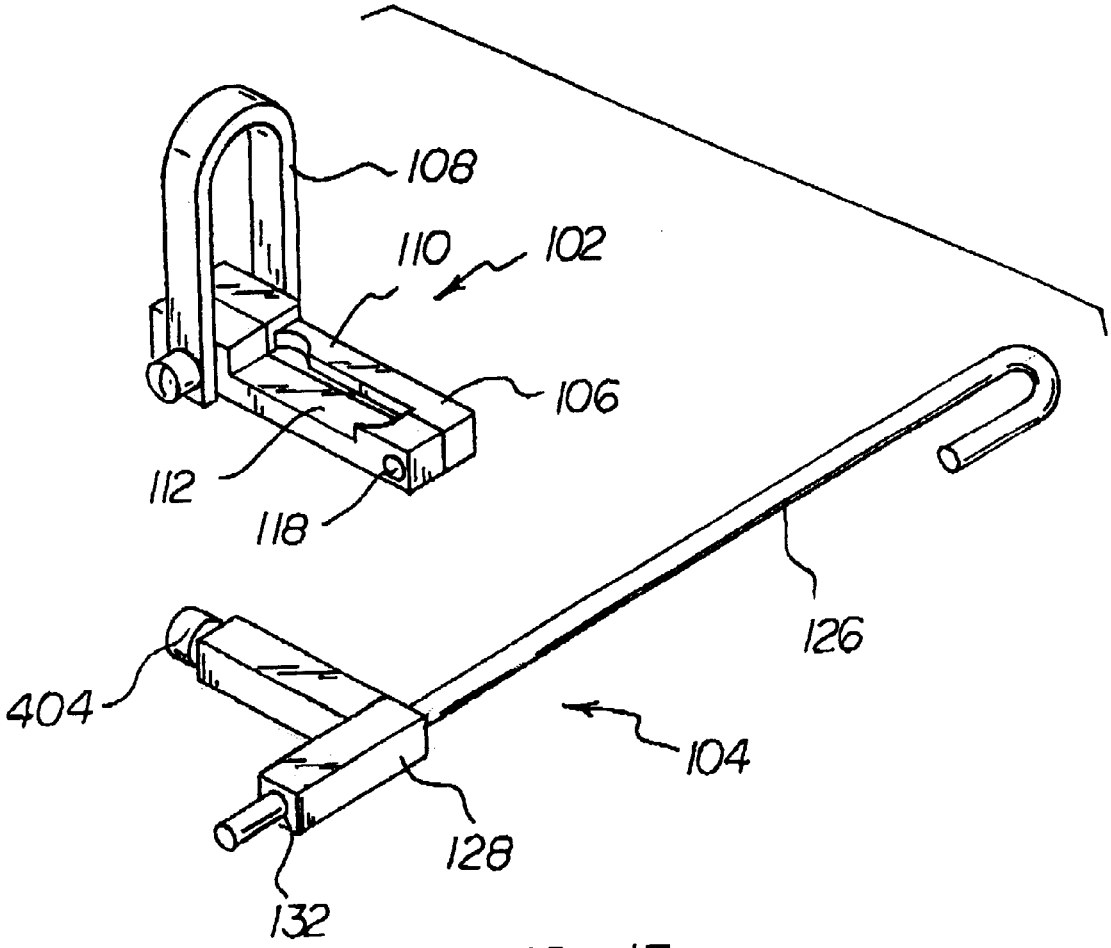

FIGS. 13A, B and C are perspective views of the components shown in FIG. 13.

Figure 14:
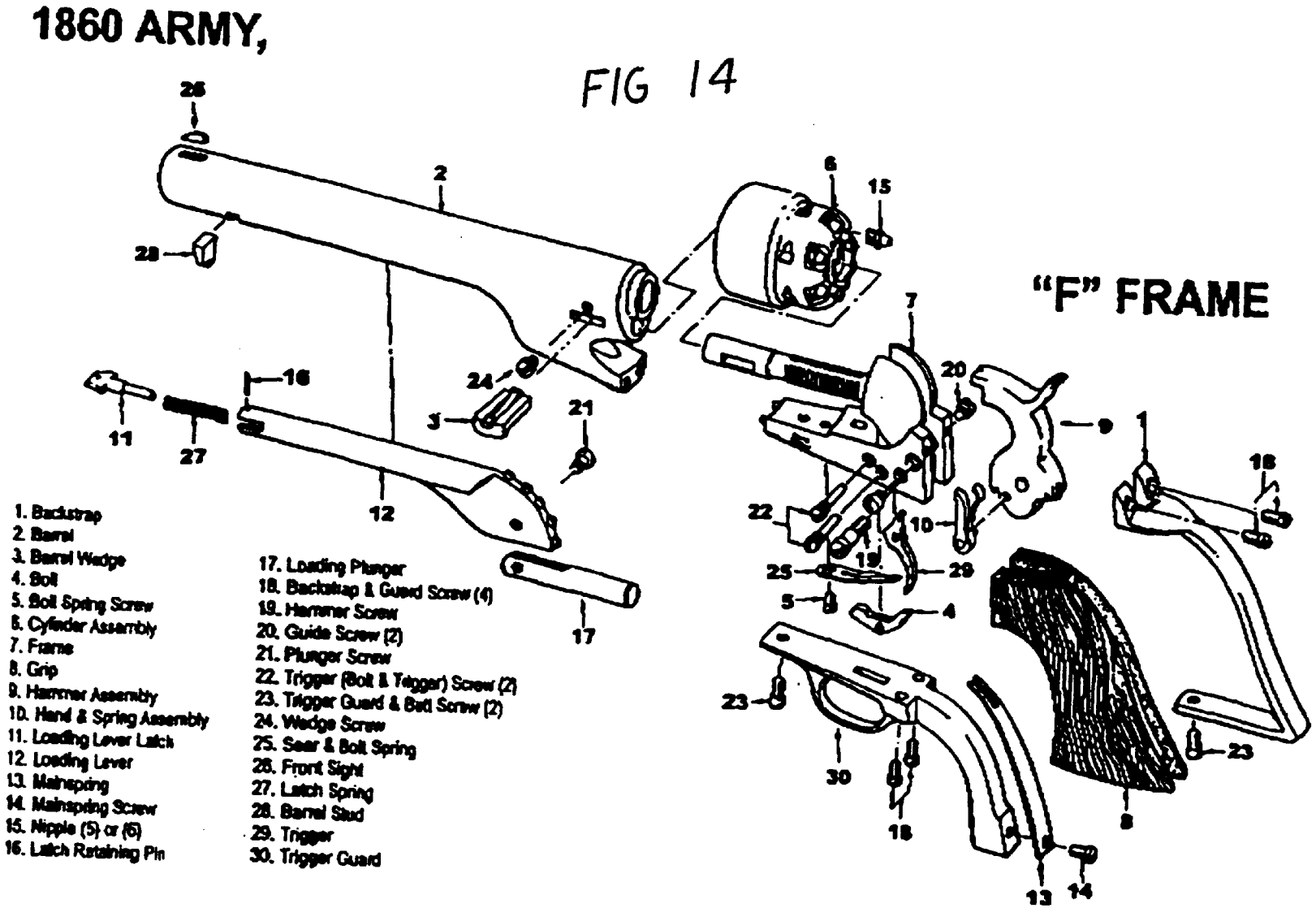

FIG. 14 is an exploded view of an existing replica of a 1860 ball and cap pistol.

FIGS. 15 and 15A are perspective views of modified short and long barrel sleeve similar to FIGS. 4 and 5.

FIG. 16 is an enlarged view of the ends of the barrel extensions shown in FIGS. 15 and 15A.

Figure 17:
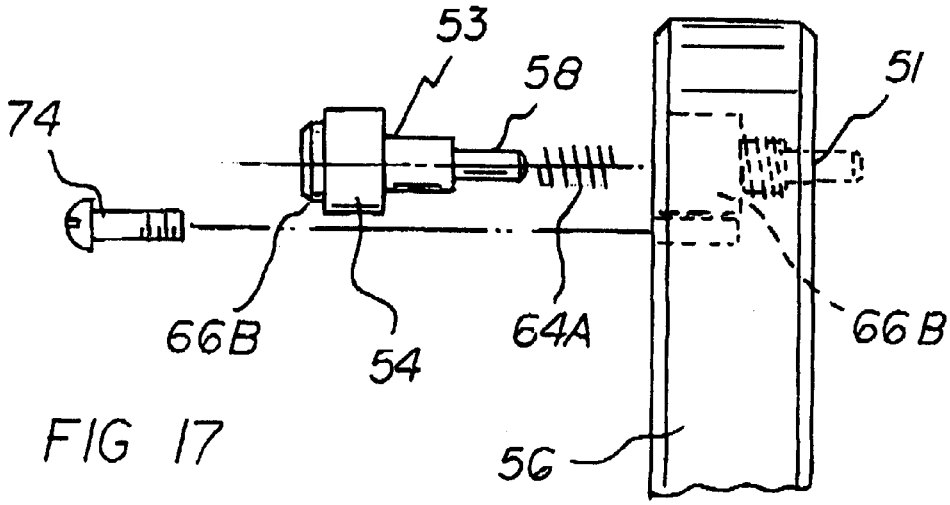

FIG. 17 is a side exploded elevation view of the firing pin ring similar to that shown in FIG. 9.

Figures 3, 3A, 3B, 3C, 3D:
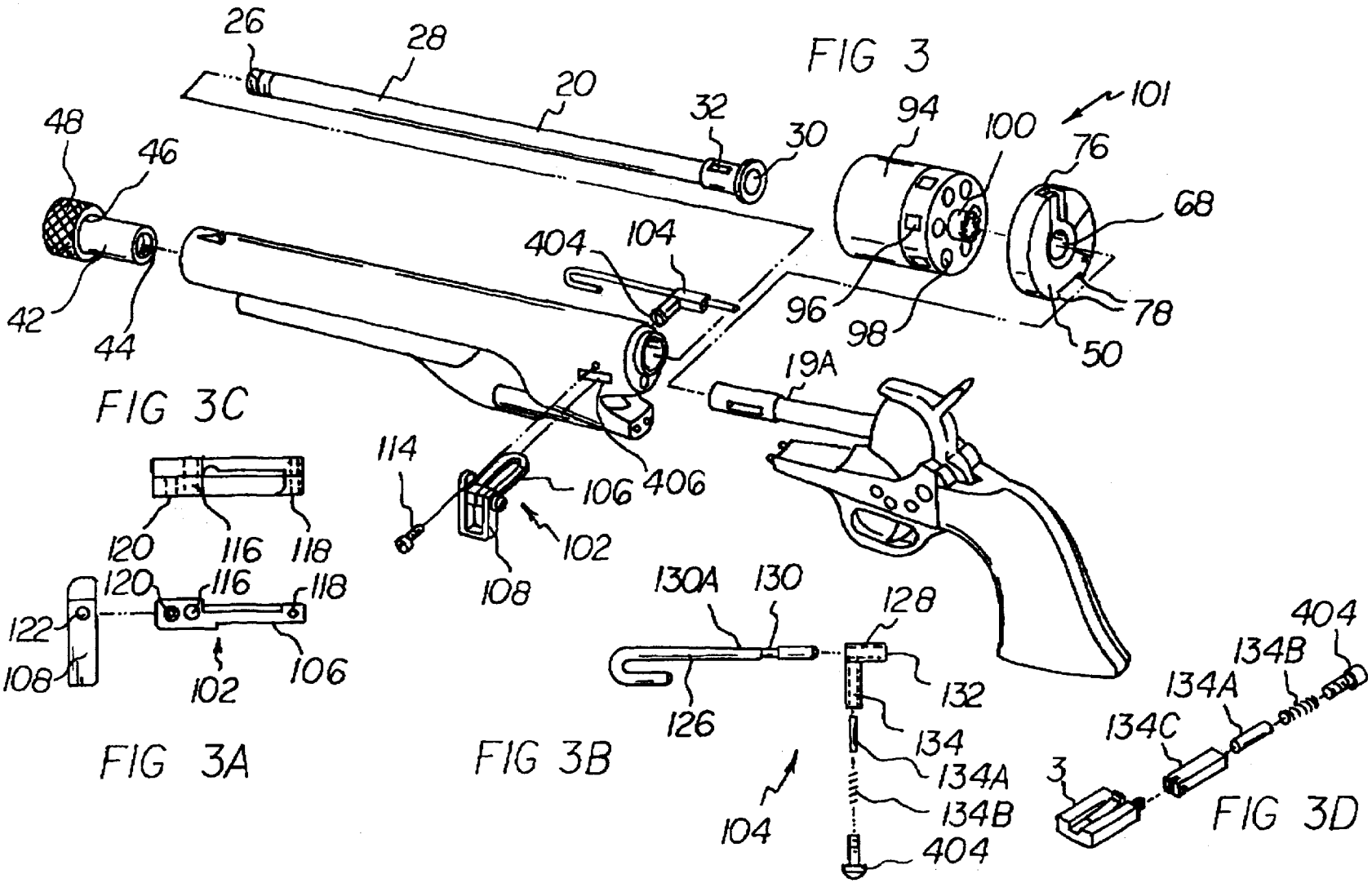
FIG. 3 is an exploded view of the pistol barrel, frame and conversion system.
FIG. 3A is a side, exploded, elevation of the barrel wedge.
FIG. 3B is a side, exploded, elevation of the unloading rod and housing.
FIG. 3C is a top view of the wedge assembly of the prior Figures.
FIG. 3D is a perspective illustration of an alternate embodiment of the wedge assembly.
Figure 7:
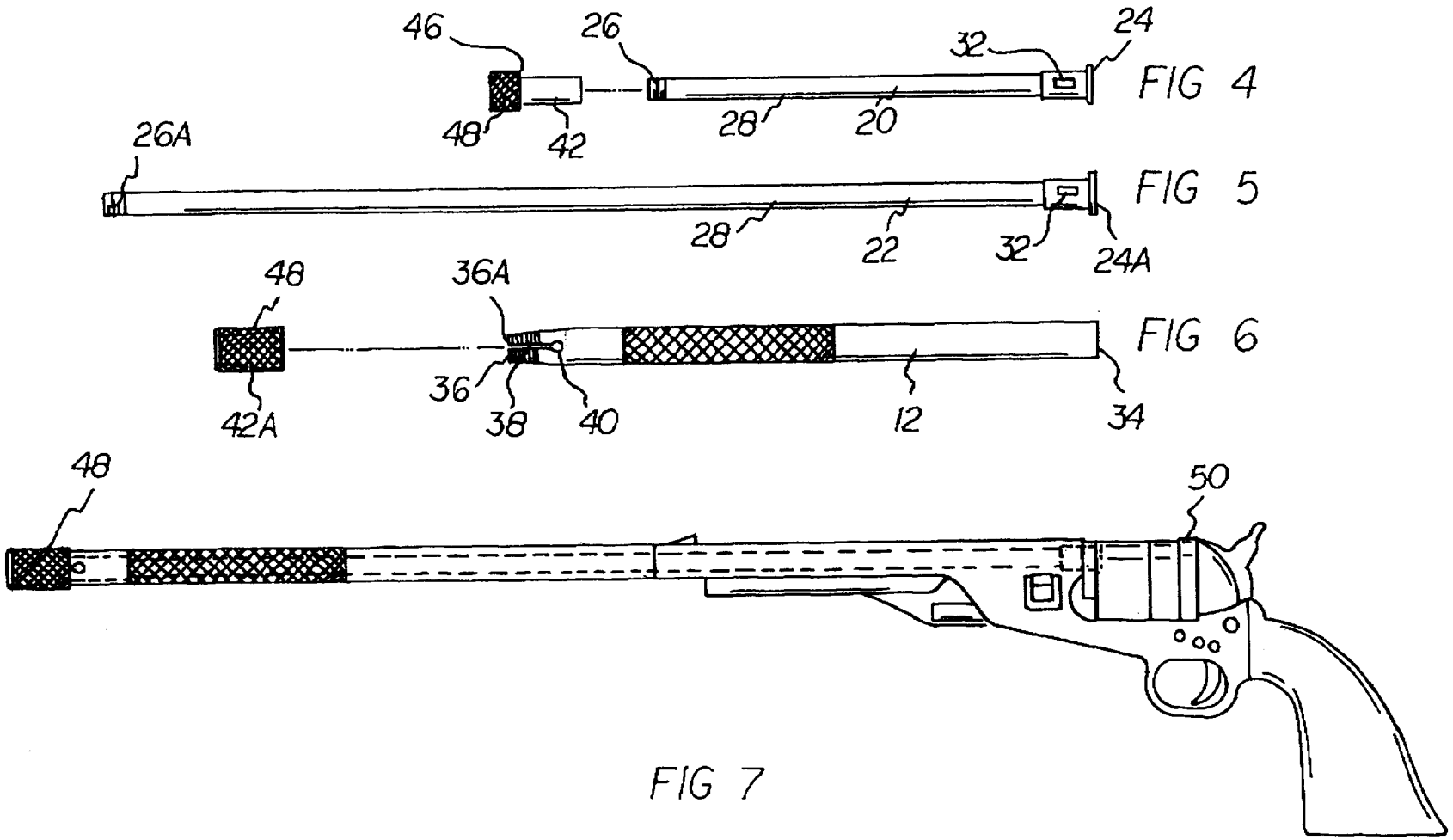
FIG. 7 is a side elevation of the conversion system, in particular, utilizing the long barrel tubular sleeve and tapered barrel nut.
Figure 18:
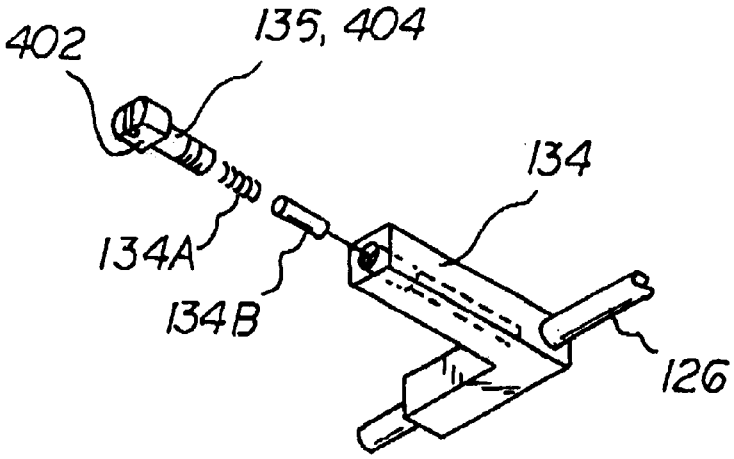
Figure 18A:
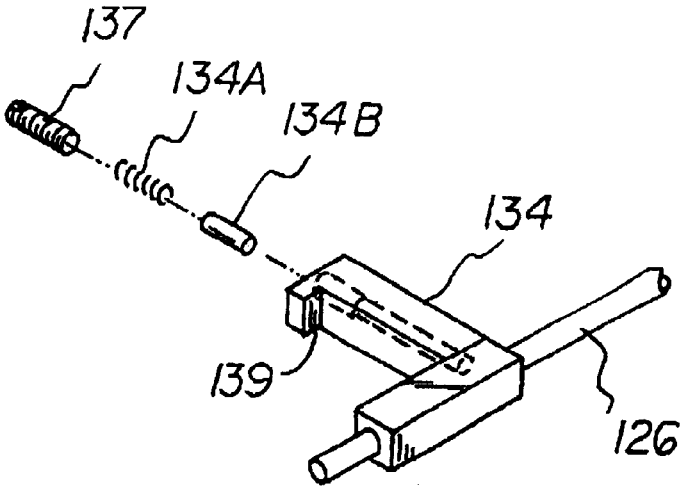

FIGS. 18 and 18A are exploded view of the modified unloading housing shown in FIGS. 3B, 13, 13C.

FIG. 19 a side elevational view of the solid frame pistol with a barrel sleeve in place and the sleeve nut facing the cylinder.

FIG. 20 is an exploded view of a barrel sleeve with an octagonal lip and the barrel sleeve nut of the present invention.

FIG. 21 is an end view of a modified barrel taken along line 21—21 of FIG. 20.

Figure 22:
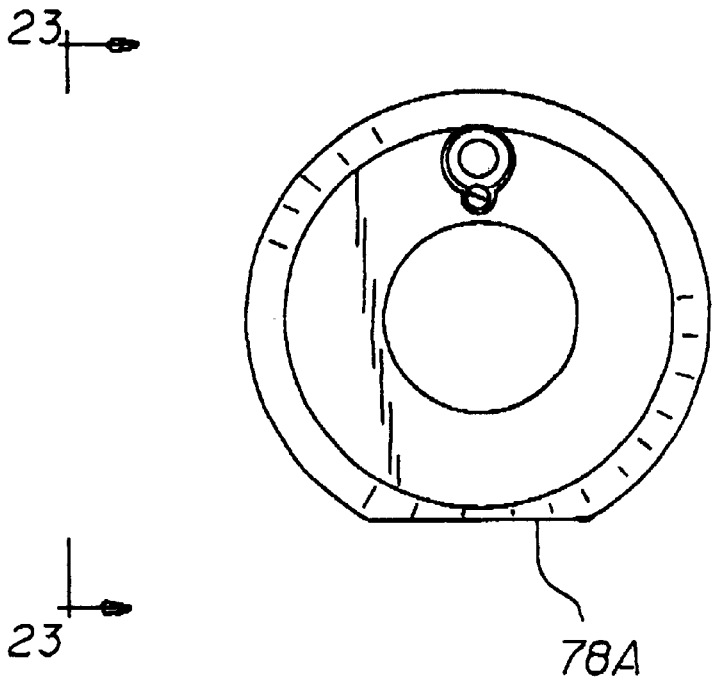

FIG. 22 is an end view of a modified firing pin ring assembly without the loading gate.

Figure 23:
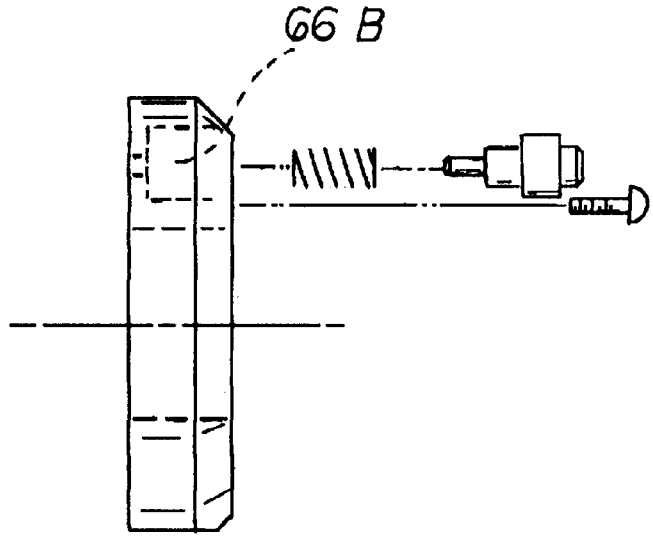

FIG. 23 is a side exploded view of a modified firing pin ring assembly taken along line 23—23 of FIG. 22.

Figure 24:
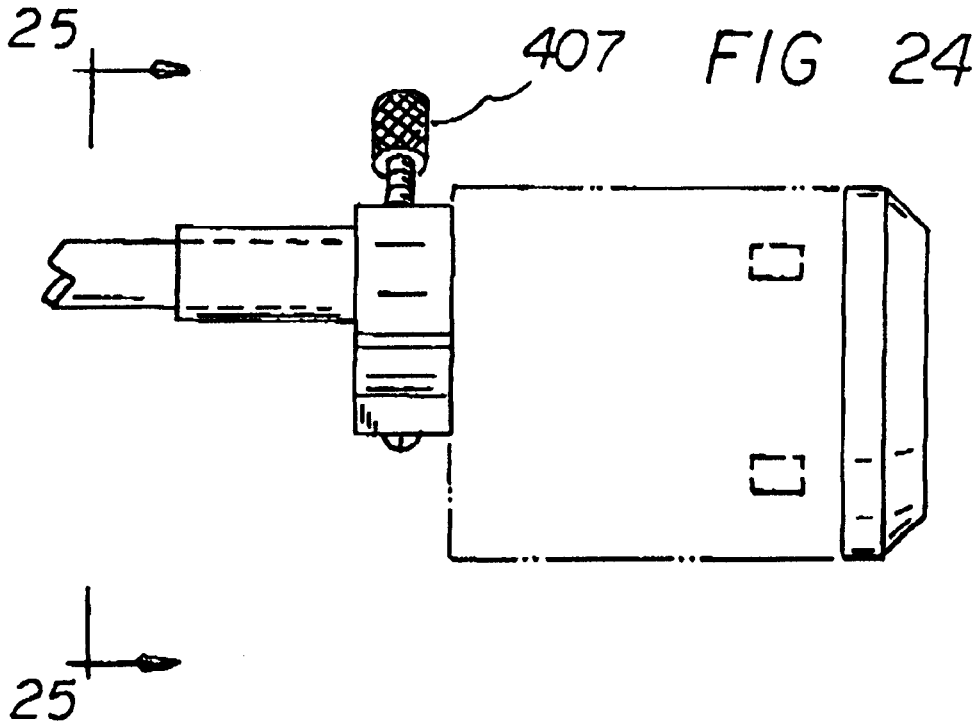

FIG. 24 is a perspective view of a modified barrel sleeve nut with hook.

Figure 25:
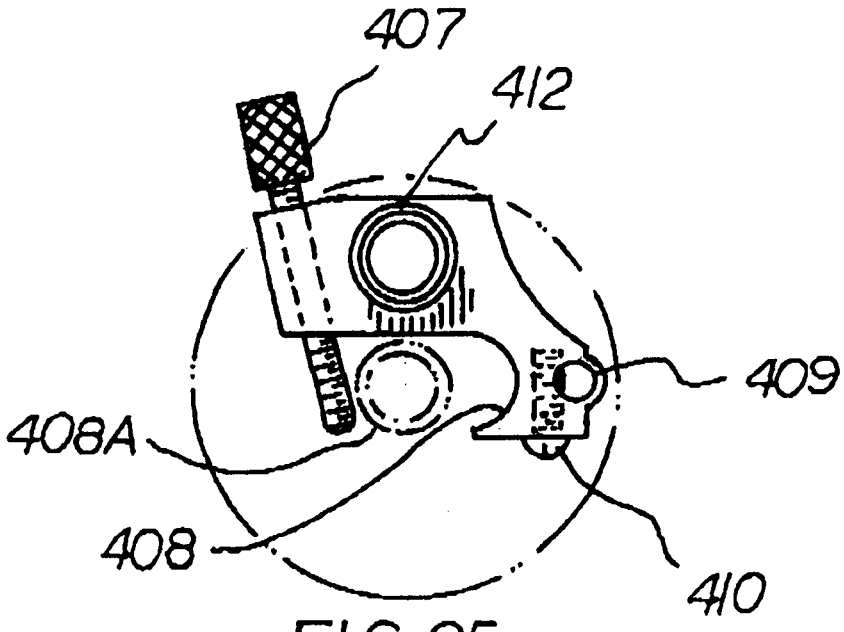

FIG. 25 is an end view of the modified barrel sleeve nut with hook taken along line 25—25 of FIG. 24.

FIG. 26 is a modified unloading rod similar to that shown in FIGS. 13, 13C and 3B.

FIG. 26A is an exploded view of modified loading rod assembly associated with barrel sleeve with hook shown in FIGS. 24 and 25.

FIG. 27 is a side elevational view of a modified cylinder shaft.

FIG. 28 is a rear elevational view of a modified firing pin ring with a loading gate similar to that shown in FIG. 8.

The same reference numerals refer to the same parts throughout the various Figures.

DESCRIPTION OF THE PREFERRED EMBODIMENT

With reference now to the drawings, and in particular to FIG. 1 thereof, the preferred embodiment of the 0.22 caliber long rifle removable conversion system kit for open top frame black powder, ball and cap colt reproduction and replica revolvers—recreation and gallery shooting embodying the principles and concepts of the present invention and generally designated by the reference numeral 10 will be described.

The present invention is a system 10 comprised of a plurality of components. Such components in their broadest context include two barrel tubular sleeves 20 22, a barrel sleeve nut 12 and 46, a cylinder 94, a firing ring 50, a wedge subassembly 102 and an unloading rod assembly 104, a stock 136 and a scope mount 158. Such components are individually configured and correlated with respect to each other so as to attain the desired objective.

The system comprises two barrel tubular sleeves 20 22, known as barrel sleeves, one being shorter 20 and one being longer 22. The shorter barrel sleeve 20, FIG. 4, is between about 6 and 8 inches long. The longer barrel sleeve 22, FIG. 5, is between at least 16.5 inches long and 20 inches long and it is made of a tube bored for a 0.22 long rifle cartridge 0.438 inch in diameter with 7/16–20 threads 26A at one end and a flanged lip 24A at the other end. Each of the barrel tubular sleeves is comprised of a hard material, such as metal. The short sleeve 20 has an inlet 24, an outlet 26 with a 7/16–20 thread, a connecting barrel 28, an inside diameter, an outside diameter and a central aperture 30 which is continuous throughout the barrel sleeves between the ends.

The outside diameter of the shorter barrel sleeve has a threaded outlet and connecting barrel sized to fit loosely within the barrel of a black powder pistol. The outside diameter is about 0.375 inch.

The inlet is configured in a flange-like shape. The flange has a smaller and a larger component. The smaller component has a cylinder-like shape. It is sized to fit snugly into the inside diameter the of the inlet of the pistol barrel and has a plurality of raised dimples 32 to fit the rifling of the 0.44 caliber pistol barrel which are sized to fit tightly into the inlet of the barrel of the pistol. The large portion of the inlet is disc shaped. The disc shape is perpendicular to the smaller component of the inlet and forms a flange lip having a central aperture. The central aperture has an inside diameter of between about 0.17 and 0.25 of an inch which is consistent with the barrel inside diameter.

The longer barrel sleeve is not configured as the shorter barrel sleeve. The longer barrel sleeve is made of a barrel longer than 16–½ inch. It is bored for a 0.22 long rifle cartridge. It is 0.439 inch in diameter and has a flanged lip on one end and a 7/16–20 thread at the other end. The long barrel nut 12, FIG. 6, is a tubular cylinder having an outside diameter to match that of the existing pistol barrel. The long barrel nut functions to cover and protect the longer barrel sleeve portion which protrudes from the pistol barrel. The inlet 34 of the longer barrel nut is cut at a right angle to the central bore of the tube of the barrel extension. The outlet 36 of the longer barrel nut is configured with a tapered outlet end, with the outside thread being made to accommodate a 3/8–18 pipe tapered nut and an inside 7/16–20 thread 36A to accommodate a 7/16–20 thread from the end of the longer barrel nut end 26A, FIG. 6.

There are four letting slits 38 between about 0.50 and 1.0 inch in length from the outlet end, going inward. There are four letting apertures 40 having a diameter of between about 0.10 and 0.20. of an inch. These are drilled at 90 degree angles to each other about a circumferential line at the location of the inboard extreme of the letting slits. These apertures are approximately 1.0 inch from the outlet of the longer barrel nut. The four letting slits 38 and the apertures 40 function to make the outlet 36 of the longer barrel nut 12 flexible when the locking nut 42A is turned on the outlet of the longer barrel nut outlet 36.

The short barrel sleeve is secured with a barrel sleeve nut 42 which comprises an inlet, an outlet and a portion therein between. It is preferably made of hard metal, and has a uniform central aperture 44. One configuration of the nut has a stepped cylindrical configuration 46. The inlet is round and the outside diameter of the inlet is sized to fit within the inside diameter of a pistol barrel.

The nut has a length of between about 0.5 and 1.0 inch. The inlet is female threaded on the inside diameter of its aperture. It is threaded to mate with the male threaded portion of the threaded outside diameter of the barrel sleeve. The outside diameter of the inlet is sized to fit snugly into the inside diameter of the outlet of the pistol barrel.

The outlet portion of the barrel nut is larger, approximating the outside diameter of the pistol barrel which is between about 0.5 and 1.0 inch in diameter. The barrel nut has a knurled surface 48 for positive grip of the larger outlet portion.

The longer barrel sleeve nut 42A, FIG. 6, is locked with a locking nut. The locking nut has a tapered internal 3/8–18 pipe thread in the inlet so as to allow slight compression of the longer barrel nut outlet 36 as it is tightened which has external 3/8–18 pipe threads. The compression of the longer barrel nut outlet around the barrel tubular sleeve secures the sleeve in position. The nut has a round cylindrical configuration with the interior diameter of the inlet being round and tapered inwardly. The nut has a length of between about 1.0 and 1.5 inch. The inlet is female threaded 3/8–18 pipe tapered on the inside diameter of the aperture. This thread mates with the tapered threaded portion of the threaded outside diameter of the longer barrel nut. The outside diameter of the nut is larger than the outside diameter of the existing pistol barrel and has a length of between about 1.0 and 1.5 inch.

There is a firing pin ring assembly 50, having a doughnut-like shape. It is comprised of a loading gate subassembly 52, a firing pin subassembly 54 and a firing pin ring 56. The firing pin subassembly has an inboard and outboard component. The inboard component comprises a solid cylinder having an inboard and outboard portion. The inboard portion is cylindrically round with a flat striking end 58. The overall diameter of the inboard component is between about 0.01 to 0.15 of an inch, preferably 3/32 of an inch and has a length of between about 0.10 and 0.33 of an inch.

The outboard component of the firing pin subassembly, having an inboard and an outboard portion is a solid cylinder 60 with an outside diameter of between about 0.01 and 0.30 of an inch, preferably 7/32 of an inch. The inboard portion has a threaded aperture 62 to receive the end of the outboard portion of the inboard component of the firing pin subassembly. There is a spring nest 64 on the inboard side, below the firing pin threaded aperture 62. The firing pin return spring 64A nests in this aperture.

The outboard portion has a flat-ended, cylindrical-shaped outboard hammer striking portion 66. The firing pin ring has an inboard and outboard face and a generally cylindrical configuration. It is between about 0.25 and 0.50 of an inch in thickness and has a diameter of between about 1.25 and 2.0 inches. There is a central aperture 68 of between about 0.40 and 0.80 of an inch in diameter, which passes through the ring from inboard to outboard. There is a recess 70 surrounding the central aperture which is between about 0.10 and 0.20 of an inch in depth and between about 0.8 and 1.0 inch in diameter.

A firing pin subassembly aperture 72 passes through the ring, in which the firing pin subassembly is housed. A subassembly locking screw aperture 74 is located just below and tangent to the firing pin subassembly aperture 66A. A locking screw is threaded into the subassembly locking screw aperture and holds the firing pin subassembly in position.

There is a stepped cylinder groove 76 at the upward most edge of the firing ring perpendicular to the outboard face. The groove is located above the firing pin subassembly aperture. The groove begins at the outboard edge of the ring and has a depth of between about 0.25 and 0.35 of an inch. The step is located between about 0.12 and 0.20 of in inch from the outboard edge of the firing ring. The step is placed approximately midpoint of the groove. It is wide enough to accommodate the width of the existing pistol hammer and prevents the end of the firing pin 66 from mushrooming when struck by the hammer.

There is a flattened surface area in the lower quadrant of the cylinder circumference of between about 60 and 90 degrees of arc. It is opposite the firing pin subassembly aperture on the lower surface of the cylinder. It is configured to receive the frame of the pistol. The flattened area indents into the firing pin ring forming retention points 78 which function to retain the firing pin ring in position and prevent rotation of the ring about the central shaft of the frame of the pistol when the gun's cylinder is rotated by the pistol frame's rotating hand.

In an alternate embodiment, as can be seen in FIG. 8A, one of the retention points 78, FIG. 8, can be made adjustable made of a curved flat spring steel 78S, FIG. 8A, about 3/32 inch thickness and the width of the steel is about the width of the firing pin ring assembly. It has a hinge on the top with a half shape radius and a 1/16 inch hole, with this hole to be attached to the side of the firing pin ring assembly. Also, it has two holes, one tapped for a 6-40 thread 404B, FIG. 8A. This is for an adjusting screw. Turning the adjusting screw increases or decreases the space in between the retention points 78. Once the desired space is achieved it can be locked with the locking screw 404A, FIG. 8A. The second hole is for a 6-40 screw which is a locking screw and it is aligned with a 6-40 threaded hole 404C, FIG. 8A, drilled on the side of the firing pin ring. When this screw is tightened, the adjustable retention mechanism is locked in place with the desired space to fit snugly the gun's frame. The two screws are 1/4 inch apart from each other. The side of the firing pin ring assembly has to be machined including a nest for the hinge, drilled and tapped accordingly in order to take the adjustable retention mechanism. With or without this mechanism the system works just as well. This is strictly for a snugger fit of the firing pin ring assembly on the gun's frame.

A loading gate locking pin nest 80 is drilled into the ring above and parallel with the flattened surface of the lower firing pin ring allowing the insertion of a spring and loading gate locking pin. A loading gate pivot aperture 82 is drilled in an inboard direction from the outboard surface of the firing ring above the locking pin nest and runs perpendicular to the outboard surface. The continuity of the firing pin ring is interrupted and opened by a wedge-shaped cut which is a congruously-shaped to allow the close fit of a loading gate subassembly. There is a radius cut 84 in the innermost aspect of the wedge cut in the firing ring to allow the passage of modern cartridge into the cylinder. Without the radius cut 84, the 0.22 long rifle cartridge cannot be loaded in the cylinder.

The loading gate subassembly 86 comprises a loading gate with an attachment tab 88, loading gate pivot pin 90 and gate locking pin 92. This subassembly is mated to the wedge shaped opening in the ring and is attached to the firing ring by the loading gate pivot pin.

The gate locking pin is nested in the body of the firing pin ring within an aperture which is drilled parallel with the lower flattened area. The aperture is perpendicular to the central shaft aperture and the gate locking pin is held in place by the loading gate tab. This configuration allows the rotation of the loading gate about 90 degrees around the pivot pin, with the locking pin capable of retaining the gate in an open or closed position.

The 0.22 caliber cartridge cylinder is exactly the same as the cap and ball cylinder except that the percussion nipples are machined down and replaced with the firing pin doughnut. Also, the face of the cylinder is machined down about 1/32 inch in order to accommodate the lip from the 0.22 caliber barrel sleeve, FIGS. 4, 5, 15, 15A and 20. It is machined down about 5/16 of an inch leaving a neck 408A when it is used on a solid frame gun 408, FIGS. 19, 24, 25, in order to accommodate the barrel sleeve nut.

A cartridge cylinder 94 has a length of between about 1 and 2 inches, and a diameter of between about 1.5 and 2.5 inches. The cartridge cylinder has an inboard and an outboard surface. It is cylindrical in shape with semi-circular locking lug depressions 96 on the long outside wall of the cylinder. It has cartridge apertures 98 which run the length of the cylinder from inboard to outboard. The cartridge apertures are between about 0.20 and 0.25 of an inch in internal diameter. They are positioned in a circular, circumferential orientation around the cylinder's central shaft aperture and run through the length of the cylinder.

There is a cylindrical rotation ratchet 100 on the outboard side of the cartridge cylinder. The ratchet is cylindrical in shape with a saw-toothed ridge on the outward, outboard edge. The teeth are configured to mate with and engage the existing rotation hand of the pistol frame. The ratchet fits through the central aperture of the firing pin ring and engages the pistol frame mechanism. The locking lug depressions on the outside long surface of the cylinder mate with and engage the existing pistol locking bolt of the pistol frame.

A barrel wedge assembly comprises a wedge subassembly 102 and an unloading rod assembly 104. The wedge subassembly and unloading rod assembly replace the existing barrel wedge which is shown in FIG. 14. The barrel wedge subassembly has an over all thickness being between about 0.15 and 0.30 inches in width. It comprises an expanding wedge portion 106 and an extraction portion in a form of a U-shaped lever 108. Note FIGS. 13A, 13B, 13C, 3 and 3A. The expanding wedge portion is two strips of rigid material with an upper surface 110 and a lower surface. The strips are positioned side by side.

The rearward metal strip has an indent 112, FIG. 13B, on the upper surface to accept the wedge screw. The wedge screw 114 is threadedly attached to the existing pistol barrel and retains the wedge, preventing it from pulling from the wedge opening in the barrel of the existing revolver on the exploded print of the existing 1860 model, the screw is marked number 24, FIG. 14.

There are two aligned apertures through the two pieces of the wedge. The attachment aperture 116 is located on the outboard side. The rivet aperture 118 is located on the inboard side. A third aperture, the distractor aperture 120, is located outboard of the attachment aperture. This aperture extends through only one metal strip. A distractor 6/32 set screw is threaded into the single unmatched aperture 120, FIG. 3C. It is used to mechanically separate the metal strips, spreading the strips and enlarging the horizontal width of the wedge. The rivet aperture is drilled smooth to receive a pin of between about 0.060 and 0.090 of an inch in outside diameter.

The extraction portion of the barrel wedge subassembly is configured from a single strip of a rigid material, preferably metal. It is U shaped with an over all thickness 108 being between about 0.15 and 0.30 inches in width. The extractor portion has two parallel sides with one being longer than the other and a perpendicular connecting cross member. The sides create an opening opposite of the cross member.

A pivotal pin aperture 122 is sized to allow passage of a 6-32 cap head screw and is made at the end of the shorter side. A pivotal aperture on the long side 124, FIG. 13A, which is threaded to receive a 6-32 cap head screw, is aligned with an identical pivotal aperture on the short side. These apertures are equidistant from the cross member of the subassembly and align with the attachment aperture of the wedge.

The wedge is attached to the extraction portion of the barrel wedge by a 6-32 cap head screw. The screw passes through the aperture in the short side of the extractor portion, then through both of the strips of the wedge. It is then threaded aperture into the long leg of the extractor portion of the wedge subassembly.

As can be see in FIG. 3D, the barrel wedge 3, FIG. 14, can be combined with the L-shaped unloading rod housing by eliminating the short leg of the L-shaped unloading rod housing and by attaching with a hinge the long leg of the L 134C, FIG. 3D, to the barrel wedge 3, FIG. 14, the pin 134A, the spring 134B and the 5-40 screw you will re-pin with the long leg 134C. The 5-40 screw 404 has the same purpose like previously to keep the wedge in its location 406. The hinge allows the long leg 134C to flip down to stay out of the way when the wedge is in its location. When the long leg is flipped up in a horizontal position and the wedge is pulled out from its location, the long leg is prevented from coming out completely by the 5-40 screw 404. At the same time the long leg will permit the barrel to separate from the gun only 5/16 inch. It will not permit the gun to come apart completely. This works pretty much like the original wedge assembly except that the wedge described above has no unloading rod. The purpose of spring 134B and pin 134A is to have the long leg 134C snug when it is flipped up or down.

An unloading rod assembly 104 comprises an unloading rod 126 and an unloading rod housing 128. The unloading rod has an inboard and outboard end. It ha an overall length of between about 2 and 4 inches long and between about 0.12 and 0.20 inches in diameter. It is made of rigid material, preferably of steel. It has its outboard end shaped in a U which has a radius of between about 0.10 and 0.30. The length of the U of the unloading rod is between about 0.50 and 0.90 inches in length. There is a circumferential groove 130 of between about 260 and 280 degrees around the outside diameter of the unloading rod located at a distance of between about 0.50 and 1.0 inch from the inboard end. This partial groove leaves a smooth area of between about 80 and 100 degrees of the rod's circumferential surface between the ends of the groove.

The unloading rod is a steel rod 5/32 inch in diameter having at one end a groove where the 3/32 inch pin pops in holding it in position. The other end of the rod is bent backwards completely about 3/4 inch in length. Starting from the groove and going toward the bent part, in a shape of a spike 130A, is a flat side of the rod. Note FIG. 3B. This will allow the rod to slid up and down pushing out the empty shells from the cylinder. This will happen in one position only when the flat side is facing the 3/32 inch pin 134A, FIG. 3B. In any other position of the rod, it will stay locked and will not slide up and down. The unloading rod housing has an inboard and an outboard side, with an over all thickness being between about 0.15 and 0.30 inches in width. It is L shaped with the inboard leg of the L being longer than the outboard leg. The short outboard leg is oriented parallel with the center line of the bore of the revolver, in line with a lateral chamber of the revolver's cylinder. It has an aperture 132 with the diameter of between about 0.145 and 0.165 of an inch through the length of the short leg, which allows the push rod to be housed within this aperture.

The long leg of the L shaped unloading rod housing is oriented perpendicular to the center line of the revolver. It has an inboard and outboard portion. It has a through aperture 134 of between about 0.09 and 0.12 of an inch in diameter communicating with and meeting with the short leg of the unloading rod housing. The inboard end of that aperture is threaded to the size of about a 5-40 screw 404, FIG. 3B. A spring 134B and a pin 134A which intersect the aperture of the housing, are retained within the confines of the through aperture 134 by this screw and prevents the unloading rod assembly from coming out of its revolver wedge hole location. The wedge subassembly 102 is moved in and out of the same location 406, FIG. 3. The unloading rod assembly 104 always stays in the location 406, FIG. 3, so that the barrel separates from the frame only 5/16 inch when the barrel wedge subassembly 102 is pulled out. The aperture of the housing runs in a course perpendicular to the path of the pin. The pin 134A and spring 134B, FIG. 3B, function as a holding pin to prevent inadvertent movement of the unloading rod. The long leg is positioned within the existing revolver wedge hole 406, FIG. 3, just inboard and parallel to the expanding wedge.

Figure 10:
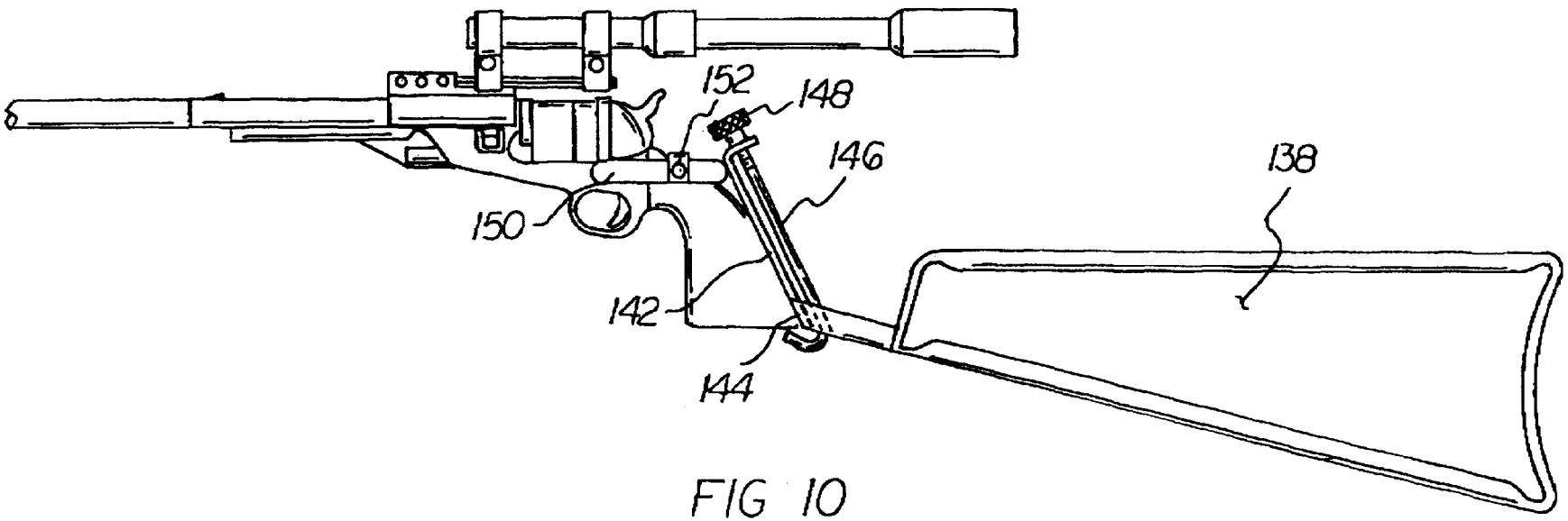
FIG. 10 is a side elevation of the conversion system including the scope mount and stock assembly.
Figure 11:
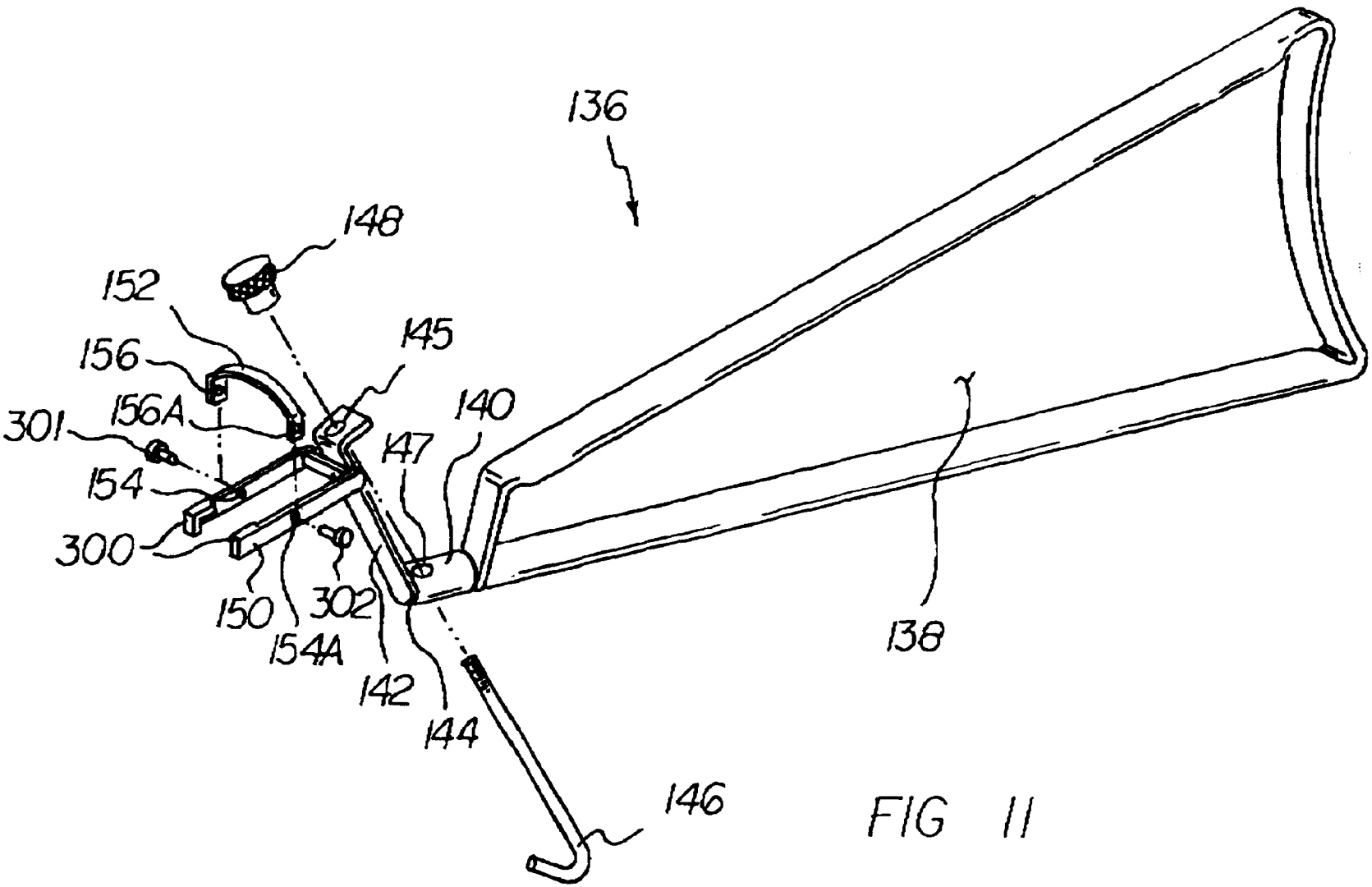
FIG. 11 is an exploded perspective of the stock assembly.
Figure 12:
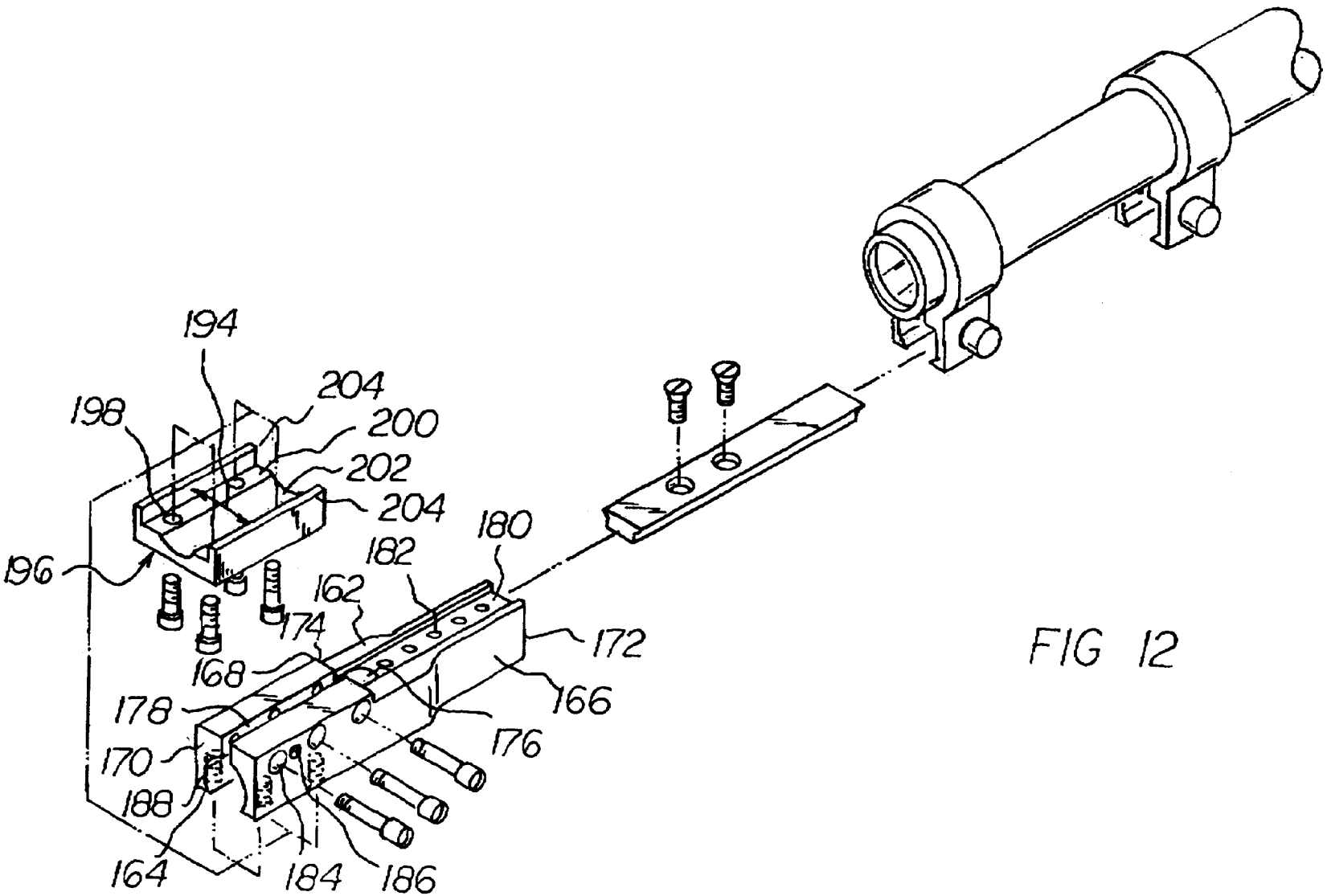
FIG. 12 is an exploded perspective of the scope mount including an optical scope to demonstrate the relationship.
Figure 12D:
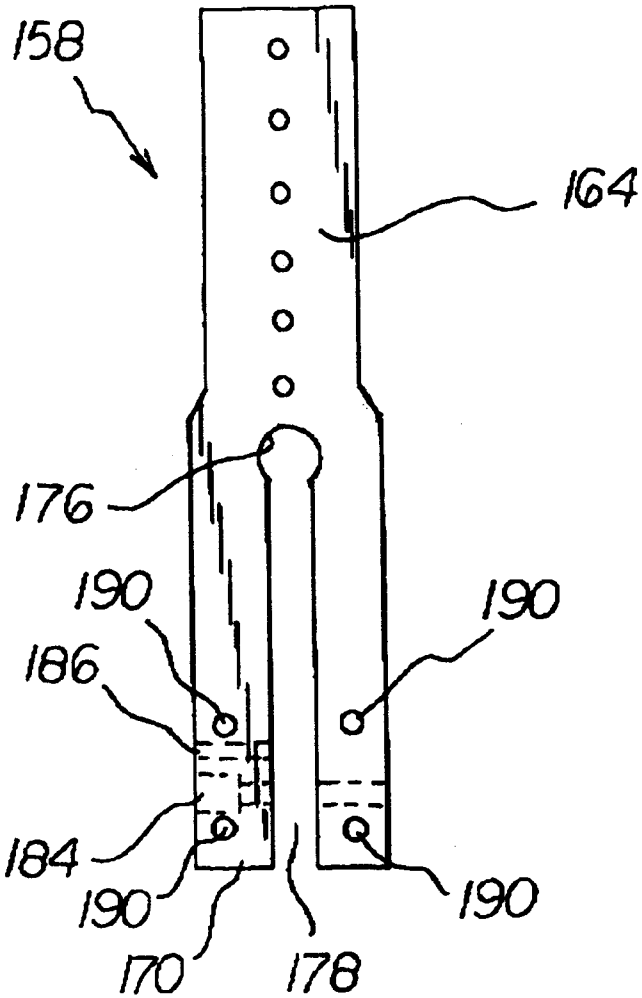
FIGS. 12A, B, and C are top end and bottom views of the scope mount plate while FIG. 12 D is a bottom view of the scope mount.
Figure 12A:
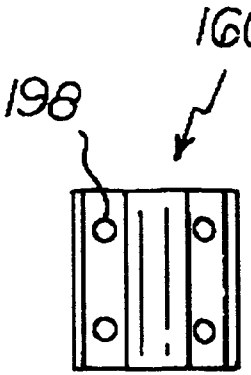
Figure 12B:
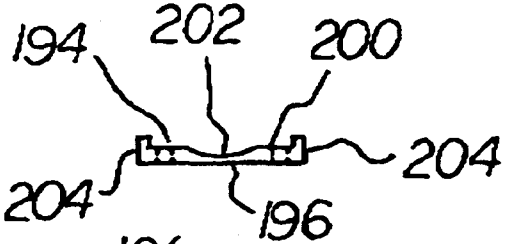
Figure 12C:
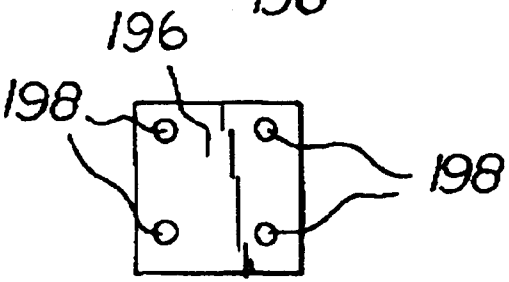

There is a skeleton pistol grip shoulder stock 136, FIGS. 10 and 11, comprising the components of a main stock wedge 138, a tubular rounded extension 140, an upward grip member 142, a connecting weld 144, a hook 146 and nut 148, a horizontal grip member 150 and a vertical cross grip member 152. The main stock wedge has an upper, lower, inboard and outboard component. It is made of a rigid, light weight material, preferably a rigid tubular plastic or tubular metal of between about 0.36 and 0.75 of an inch in the outside diameter. The main stock wedge upper and lower components are almost equal in length and run at a converging angle of between about 5 and 20 degrees. The wider distance between the upper and lower components is at the outboard extreme and the narrower distance is at the inboard extreme of the upper and lower components. Each of those components is between about 12 and 20 inches long. The outboard component is between about 4 and 6 inches long and connects the upper and lower components. It has a generally concave configuration.

The shorter inboard component is between about 1 and 3 inches long. It connects the innermost end of the upper component with a point on the lower component between about 1 and 2 inches from the innermost end of the lower component. This connection creates an angle of between about 75 and 90 degrees at the point of meeting with the lower component.

The outermost end of the tubular rounded extension is a continuation of the lower component. It is about 1 and 2 inches long, having an inboard and outboard portion. The inboard portion has an aperture between about 0.20 and 0.30 of an inch. The aperture 147 is angled at between about 60 and 85 degrees from the center line of the tubular rounded extension. It is located at between about 0.25 and 0.50 of an inch from the innermost end.

The upward grip member 142 is constructed of an L shaped rigid material, preferably steel, having a short leg and a long leg. A weld 144 securely couples the stock tubular rounded extension with the end of the long leg of the upward grip member. This joint forms an angle of between about 60 and 85 degrees from the center line of the tubular rounded extension.

The short leg is distant to the point of connection to the stock wedge and has the L bent in the general direction toward the stock wedge. This bend forms an approximately 90 degree angle bend with the lower longer portion of the L shape. There is an aperture 145 being between about 0.20 and 0.30 of an inch in diameter in the short leg. The aperture is in line with the aperture in the tubular rounded extension.

There is an upward grip hook 146 of a generally solid cylindrical configuration. It is between about 3 and 6 inches long and has an outside diameter of between about 0.20 and 0.40 of an inch. It has an inboard and outboard component and a connecting shaft between. The outboard component is configured in a J hook shape. The hook will be positioned in the existing cavity at the bottom of the gun grip frame. The hook comprises a bend in the shaft having a radius of between about 0.10 and 0.25 of an inch. The inboard end is threaded to a thread size of about 0.25 of an inch in outside diameter and the connecting shaft is between about 2 and 5 inches long.

The upward grip hook nut 148 has in inboard and outboard portion. The inboard portion is cylindrical with a threaded aperture to mate with the thread of the hook. The outside diameter of the inboard portion is between about 0.40 and 0.60 of an inch and is between about 0.30 and 0.50 of an inch in length. The outboard portion of the hook not is a solid cylinder with a central through aperture. The nut has an outside diameter of between about 0.60 and 0.80 of an inch and has a knurled surface on the outward rounded circumference. There is a flattened outermost end of the hook nut.

A horizontal grip member 150 has a generally elongated C configuration. See FIGS. 10 and 11. It is made of a single piece of rigid material, preferably metal and has a width of between about 0.25 and 0.40 of an inch. The horizontal grip member has two lateral components of between about 2 and 4 inches long and one central component of between about 1 and 2 inches long. The inner lateral component has an aperture 154 for an 8/32 thread and the outside lateral component has a round cavity 154A 1/16 inch deep to receive one end of an 8/32 cap head screw. The apertures are equally spaced from the outboard open end of the C, that distance being between about 0.75 and 1.50 inches from the outboard open end of the C. The open end of the C ends with a hook on each end of the C 300.

A vertical cross grip member 152 has a shortened C shaped configuration. It is comprised of a strip of between about 0.20 and 0.30 of an inch in width. It is fabricated of a rigid material, preferably metal. It has two short lateral components and one long central component. The short lateral components are between about 0.30 and 0.50 of an inch in length, with the inner lateral component drilled for an 8/32 cap head screw having an equally spaced, centrally spaced aperture. The outer component 156A is tapped for an 8/32 cap head screw having an equally spaced, centrally spaced aperture 156A. The horizontal grip member 150 is coupled with the vertical cross grip member 152 with two screws. Screw 301 extends through aperture 156 and is threaded in aperture 154 to couple the horizontal grip member inner component 150 and cross grip member inner component 152 permanently. The entire skeleton pistol grip shoulder stock is attachable to the tapered pistol frame which conforms to the tapered shape of the pistol frame by screw 302 through aperture 156A. Rotation of upward grip hook nut 148 screw will pull the threads of the upward grip hook 146 upwardly through apertures 145 and 147 of the upward grip member. This will pull the upturned short end of the upward grip hook 146 to the lower surface of the pistol handle where is will hook in an existing cavity on the lower part of the pistol grip. As a result, vertical stability is insured between the pistol grip shoulder stock 136 and main stock wedge 138. The upper end of the upward grip member 142 has secured thereto the central extent of the horizontal grip member 150. The forward free ends of the horizontal grip member 150 have projections 300 adapted to grasp the two guide screws already available on the left and right hand sides of the Model 1860 cap and ball pistol 20. The vertical cross grip member 152 has lower ends with apertures 156 adapted to align with aperture 154 and cavity 154A. Screw 301 extends through apertures 156 and 154. Screw 302 is removable and extends through aperture 156A and pushes against 154A to conform to the shape of the pistol handle and insure a secure coupling between the stock and the pistol.

A scope mount 158 is comprised of a single piece of rigid material, preferably steel. It is a square having a width and height of between about 0.75 and 1.50 inches. It has an overall rectangular length of between about 4 and 6 inches before machining.

The scope mount plate 160 is a rectangular piece of rigid material, preferably steel having a length of between about 1.0 and 1.8 inches and a width to slightly larger than the scope mount. The scope mount plate is between about 0.20 and 0.30 of an inch thick.

The scope mount has an upper 162, a lower 164 and two side faces 166 168, with a attachment side and attachment end 170 which mounts to the pistol and a scope side and scope end 172 where the scope mounts. A horizontal step cut 174 is made in the upper face of the scope side of the mount of between about 0.05 and 0.15 of an inch to a point approximately mid-length of the scope mount. The upper face also has a large aperture 176 in the midline on the attachment side of the midpoint. The aperture is between about 0.40 and 0.60 of an inch in diameter. It is perpendicular to the upper face in the direction of the lower face.

A slot 178 having a width of between about 0.20 and 0.30 of an inch connects the large aperture of the upper face with the end of the attachment side of the scope mount. The slot is cut through the entire height of the scope mount in the midline and extends to the end of the attachment side of the scope mount.

A wide central slit 180 is machined in the surface of the stepped scope side of the scope mount and is between about 0.05 and 0.10 of an inch in depth and between about 0.40 and 0.60 of an inch wide. It runs from the beginning of the step to the end of the scope side of the scope mount. There are six apertures 182 in the central slit, being equally spaced between about 0.40 and 0.60 of an inch apart, center on center, centrally located on the midline of the scope mount length. These apertures threaded to fit a 6-32 machine thread screw.

The side faces are notched inward and have an elongated Z configuration. Both legs of the Z are parallel. The central connector of the Z is short and obliquely angled inward making a narrowed upper faced portion of the scope mount on the scope end. The narrowing is between about 0.25 and 0.40 of an inch on each side the mount. One of the side faces has three apertures 184 sized to accommodate the outside diameter of a 8-32 machine screw. The other side has four apertures, three 184 of which align with and match the three apertures of the opposite side. These three apertures are sized so as to be threaded to a size which would mate with approximately an 8-32 machine screw. The tightening of these screws draws in and compresses the sides to one another and tightens the scope mount on the pistol. The fourth aperture 186 which is located between the outboard two apertures of that side is threaded to a size to accommodate an 832 machine screw. There is no corresponding aperture on the opposite side, and this aperture with its screw functions as a spreader. It allows the insertion of the screw though the aperture to push against the opposite side.

A letting aperture 188 is drilled into the attachment side end face and has a diameter of between about 0.30 and 0.50 of an inch. It is drilled off of the center line and interrupts the lower surface of the scope mount. It forms a radius slit from the scope side end to meet with and connect with the large aperture in the upper face of the scope side of the scope mount. The letting aperture allows the compression of the attachment side of the scope mount to tighten securely on the pistol barrel.

The lower face of the scope mount has four apertures 190 drilled toward the opposite side. There apertures are threaded to a diameter to accommodate a 6-32 machine screw. These apertures are perpendicular to the lower face, and are placed two on each side of the lower face between about 0.75 and 1.50 of an inch apart.

The scope mount plate 160 has an upper face 194 and a lower face 196. The lower face being between about 1.0 and 2.0 inches in length with a width to be between about 0.50 and 0.80 of an inch wider than the width of the scope mount lower face. The plate is between about 0.220 and 0.30 of an inch in thickness and made of a rigid material, preferably steel. The plate has four apertures 198 each having a diameter to allow passage of a 6-32 machine screw sized to match the four apertures of the lower face of the scope mount.

A shallow full-length slit 200 is machined in the upper face of the scope mount plate. This slit is between about 0.120 and 0.130 of an inch in depth and wide enough to accept the width of the scope mount. The full length slit is further machined along the entire length to have a radius curve 202 of between about a 0.250 and 0.500 of an inch. This radius curve matches the radius curve of the lower face of the scope mount. The side walls 204 created by the machining of the slit have a thickness of between about 0.25 and 0.40 of an inch.

The system converts a 0.44 caliber or any other caliber cap and ball open top revolver to a 0.22 long rifle caliber cartridge revolver or in its use with a 16-½ inch barrel and a shoulder stock it converts the revolver to a 0.22 long rifle revolving carbine. To use this system, a user need not make any alteration of the gun and does not need to use any special tools to convert the gun. Simply replace a wedge, insert a sleeve in the barrel and switch the black powder cylinder with a cartridge cylinder. The conversion time is less than one minute, about 45 seconds. With this system the gun can be used as a black powder gun or if the user so desires, he can fire the economical, clean 0.22 cartridges and for gallery shooting can use the 0.22 caliber Flobert cartridge (0.22 CB) or any other primed load 0.22 caliber cartridges.

The procedure to load the gun is as follows: Lift the lever on the wedge and pull it out. Cock the hammer half way to allow the cylinder to rotate freely with one hand holding the grip of the gun and with the other hand holding the barrel of the gun and pull it apart. The unloading rod assembly 104 will allow the barrel to separate from the frame about a distance of only 5/16 inch and the gun will not come apart completely. On the original Model 1860 pulling on the barrel wedge separates it completely from the frame. Keep the gun pointed to the ground and it will stay in a loading position since the barrel, cylinder and the firing pin doughnut will slip forward by its own weight, keeping the gun open for loading. Also, you can load the gun by opening the gate on the firing pin doughnut and by pushing the cylinder up against the barrel and by holding it there with your thumb until you insert the cartridges in the cylinder through the loading gate. With the above operation, you make the appropriate room to insert the 0.22 long rifle cartridge in the revolver's cylinder. Push the barrel and wedge in place and fire the gun. Repeat the procedure to unload the gun. Use the unloading rod for unloading the gun.

In an alternate embodiment of the invention, the 5-40 screw 404 from the unloading rod housing 128, which is part of the unloading rod assembly 104 described above and shown in FIGS. 3, 3B, 13 and 13C, would be modified. The two sides of the screw 404 are machined flat 402, appearing more rectangular than round. FIG. 18, 135 (404) 402. With this modification, the screw slips through the wedge opening 406, FIG. 3, from the gun barrel without the need to be unscrewed from the long leg L shaped unloading rod housing, FIGS. 3B, 13 and 13C, in case the barrel wedge sub assembly has to be taken out from the barrel wedge opening 406, FIG. 3, in order to allow the gun to be converted.

The 5-40 screw 135, FIG. 18, holds a pin and a spring 134A, 134B, FIG. 3B, and also keeps the wedge and unloading rod assembly in its barrel wedge location 406, FIG. 3. In other words, the 5-40 screw 135, 404, FIG. 18, flattened on two sides 402, FIG. 18, will hold in one point instead of three points as originally in the prior embodiment, FIGS. 3B, 13 and 13C. The 5-40 screw 404 is also modified by replacing the original 5-40 button-head screw with a 5-40 set screw 137, FIG. 18A, and by machining the outside of the long leg L-shaped housing to have a step hook, which is going to be the holding point 139, FIG. 18A, like the flattened 5-40 screw 135, 402, FIG. 18. The above two modifications are practically the same. They both hold the unloading rod assembly in one point and allow it to slip in and out of its location 406, FIG. 3, without the need for unscrewing any screw. This makes the conversion time truly less than one minute for anybody, not only for the inventor. Without the present improvement, it may be difficult to screw and unscrew a tiny screw, 404, FIG. 3B, which could also make the pin 134A and spring 134B come out from its location 134 and eventually get lost.

Also the firing pin, originally shown in FIG. 9, would be modified in this alternative embodiment. Note FIG. 17. The striking pin 58 is on the center line with the firing pin subassembly 54. Eliminated is the spring nest 64, FIG. 9. The spring 64A, FIGS. 9 and 17, is positioned over the striking pin 58, FIG. 17, on the center line with the firing pin subassembly 54, FIG. 17. Also subassembly 54 has a step 66B, FIG. 17, entirely around for the locking screw 74, rather than just one point like the earlier embodiment 66A, FIG. 9. With this modification is it easier to fabricate a firing pin subsystem 54, FIG. 17, because it needs only one setup on a lathe machine instead of a lathe and milling machine.

On the longer barrel sleeve 22, and the short barrel sleeve 20, the raised dimples 32, FIGS. 3, 4, 5, 20, 15 and 15A, have been eliminated. On the flanged lips, at the ends 24 and 24A, FIGS. 3, 4, 5, 15, 20 and 15A, there are cut a radius shape 33, FIG. 16, which is overlapping with the cylinder shaft on an open top gun 19A, FIG. 3. This prevents the sleeve from spinning in the gun barrel when the barrel sleeve nut is tightened. This has the same function as the raised dimple, except that this is easier to be produced.

The present invention may also be used on a solid frame ball and cap revolver. Such embodiment would be similar to the present invention, except that because of the gun's solid frame, the barrel can not be removed from the gun frame. Therefore, the sleeve 20, FIG. 20, is inserted from the front of the barrel, FIG. 19, and the sleeve nut 42, FIG. 20, is inserted from the back, facing the cylinder, FIG. 19. In other words, the flange lip 24, 24A, FIG. 20, is in the front of the barrel and the nut is in the back of the barrel. This is the opposite from what is done when the sleeve is mounted on an open top gun barrel, FIGS. 3, 1, 1A, 2 and 7. The firing pin doughnut is also simplified on a solid frame gun. It is almost round with a hole in the center and flat on the bottom 78A, FIG. 22. It has no retention points 78, FIG. 8, on the bottom. It has no loading gate or any other grooves or steps except the cavity for the firing pin assembly 66B, FIGS. 17 and 23. On the solid frame gun, the firing pin doughnut without the loading gate is used with the regular barrel sleeve nut 42, FIG. 20. When the gun is used with the regular barrel sleeve nut 42, FIG. 20, the gun has to be loaded by pulling out the cylinder shaft and by removing completely the cylinder from the gun.

Also, the barrel sleeve nut in the solid frame gun can be made in the shape of a hook and is combined with the unloading rod, FIGS. 25, 26, 26A. It is the same as the barrel sleeve nut previously described 42, FIGS. 20, 3 and 4, except that on the left hand side, it has a 6-32 stopping screw which is knurled at one end 407, FIGS. 25 and 24. This screw stops the cylinder in the center line with the barrel and, by being screw out, permits the cylinder to be removed from the gun completely which is needed when the gun is being converted from a ball and cap revolver to a cartridge revolver. On the right side, as can seen in FIG. 25, the nut has a hook 408 and a 5/32 inch hole 409 intercepted by a 5-40 retaining screw for the unloading rod 410. The hook has the function of stopping the cylinder when pushed to the right side in the loading position, about ¼ inch, in order for the cartridges to be loaded in the cylinder. Without this movement the gun could not be loaded unless the cylinder is removed completely from the gun. Also because of this movement, the gun can be used with the firing pin doughnut constructed with a side loading gate 411, FIG. 28. This is the same as the firing pin doughnut described above, FIGS. 22 and 23, except for the side gate. The top of the nut with the hook is flat 412, FIG. 25, so that it locks itself in the gun frame. The gun with the firing pin ring with side loading gate is much more convenient to load.

The additional drawings, FIGS. 26 and 26A, show two unloading rods. One of the unloading rods is the same as described earlier except that the flat side 130B, FIG. 26, is completely flat and not flat in a spike shape as previously 130A, FIG. 13C. The other unloading rod is the same as the above described rod except that it does not have the inverted hook 413, FIG. 26. Instead it has a knurled handle 414, FIG. 26A screwed on the 5/32 inch rod 415, FIG. 26A, with a spring 416, FIG. 26A, under the knurled handle. Both rods have the same function, to discharge the empty shells from the cylinder. The first one is manual return while the second has a spring load return.

The lip 24, 24A, FIG. 20, on the barrel sleeve can be made octagonal, round, with or without knurls, or combinations thereof. This is to blend in with the octagonal gun barrel and in this way it can be tightened with a wrench or by hand, FIG. 21.

In order to load the solid frame gun, a user proceeds as follows:

1. Bend down the loading lever.
2. Half cock the hammer.
3. Pull out the cylinder shaft as much as possible.
4. Push the cylinder from left to right. By doing so, the cylinder will slide only about ¼ inch in a loading position. This is just to make enough clearance for the cartridges to be loaded in the cylinder.
5. Push back the cylinder shaft. It will go back only about ⅜ of an inch. It will wedge itself between the cylinder neck 408A, FIG. 25, and the hook from the sleeve nut 408, FIG. 25. It will also prevent the cylinder from sliding back unwanted in its location from the loading position.
6. Open the gate on the firing pin ring and insert the cartridges in the cylinder.
7. Close the gate, pull the cylinder shaft, push in place the cylinder, the cylinder shaft, and bend in place the loading lever.
8. Fire the gun.
9. Repeat the operation to unload the gun. Also use the unloading rod mounted on the right hand side of the barrel sleeve nut.

FIG. 27 is the cylinder shaft on every solid frame gun, except that on one end there needs a step of about ⅜ of an inch in depth 417. Without this step, the converter unit works just as fine except that the cylinder has to slide to the right twice as much, ½ inch instead of ¼ inch. As described above, the ⅜ inch step will wedge in between the cylinder neck 408A, FIG. 25, and hook from the sleeve nut 408, FIG. 25, and prevents the cylinder from slipping back unwanted in its location from the loading position. A cylinder shaft with a step may be supplied with the conversion kit. The primary embodiment of the invention includes the step, but it should be understood that the elimination of the step is still possible but the converter unit would not work as well.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A 0.22 caliber long rifle removable conversion system kit for open top frame, black powder, ball and cap reproduction and replica revolver—recreation and gallery shooting, comprising;

two barrel tubular sleeves of different length, the shorter barrel tubular sleeve and a longer barrel sleeve, the short sleeve having an inlet, outlet, inside diameter, outside diameter and a central aperture, the outside diameter of the outlet is threaded and sized to fit loosely within the barrel of a black powder pistol, the inlet being configured in a flange-like shape having a smaller and larger component, the smaller component having a round cylinder like shape with a plurality of raised dimple to fit tightly into the inlet of the barrel rifling of the pistol, the large portion of the inlet being disc shaped, the long barrel sleeve is made of a tube having at one end a thread and the other end the lip and the raised dimple;

a long barrel nut comprising a round cylindrically shaped tube having an outside tapered threaded end with four letting slits having at the end four letting apertures, the tube also having an internal thread at the same end; the long barrel nut is locked with the locking nut;

a short barrel sleeve nut comprising an inlet and an outlet and a portion therein between each having an inside and outside diameter and a central aperture, the outside inlet diameter being round and sized to fit snugly within the inside diameter of a pistol barrel with an inside diameter of the nut inlet being threaded and sized to mate with the threaded portion of the threaded barrel tubular sleeve outlet, and the outlet portion of the nut being larger, approximating the outside diameter of the pistol barrel;

a firing pin ring assembly comprised of a loading gate subassembly and a firing pin subassembly and a firing pin ring, the firing pin subassembly having inboard and outboard components, the inboard component comprising a solid cylinder having a flat striking end and an outboard component of the firing pin subassembly being a solid cylinder with a threaded aperture, the firing pin ring having an inboard and outboard face and a generally cylindrical configuration with a central aperture through the ring, a recess surrounding the central aperture, and firing pin subassembly aperture comprising a spring nest aperture, a subassembly locking screw aperture for a locking screw below and tangent to the firing pin subassembly aperture, above the firing pin subassembly aperture at the upward most edge of the cylinder is a stepped groove perpendicular to the outboard face, with the lower quadrant surface, encompassing between about 75 and 100 degrees of circumference a flattened surface to receive the frame of the pistol with the flattened area creating two retention points, a loading gate locking pin nest aperture in the ring above and parallel with the flattened surface of the lower quadrant of the firing pin ring, a loading gate pivot aperture inboard from the outboard surface of the firing ring above the locking pin nest and running perpendicular to the outboard surface, the firing pin ring being interrupted and opened by a wedge-shaped cut with an inner radius cut, a congruously-shaped loading gate subassembly comprising a loading gate with an attachment tab and a loading gate pivot pin and a gate locking pin which is mated to the opening, being rotatable about 90 degrees around the pivot pin, with the locking pin capable of retaining the gate in an open and closed position;

a cartridge cylinder with a central aperture and with locking lug depressions on the outside surface and full length cartridge apertures in a circular equally spaced circumferential orientation around a central shaft aperture with a rotation ratchet to mate with and engage the existing pistol frame; and a barrel wedge assembly comprising a wedge subassembly and an unloading rod assembly, the barrel wedge subassembly comprising an expanding wedge portion and an extraction portion, the unloading rod assembly, comprising an unloading rod and an unloading rod housing, the unloading rod being shaped in a U and a circumferential groove around the outside diameter of the rod, the housing being L shaped and having an aperture through the length of the short leg of the L allowing the rod to be housed within the aperture, the housing also having a through aperture to house a spring and a pin and a screw, the pin intersecting the aperture of the housing perpendicular to the path of the rod.

2. A 0.22 caliber long rifle removable conversion system kit for open top frame, black powder, ball and cap reproduction and replica revolver—recreation and gallery shooting, comprising;

a barrel sleeve;

a barrel sleeve nut being threaded to mate with a threaded portion of the outside diameter of the barrel sleeve and sized to fit snugly into the inside diameter of the outlet of the pistol barrel;

a firing pin ring assembly comprised of a loading gate subassembly, firing pin subassembly and firing pin ring, a cartridge cylinder being cylindrical in shape with cartridge apertures configured to mate with and engage the existing rotation hand and locking lug of the pistol frame; and a barrel wedge assembly comprising an expanding wedge subassembly and an unloading rod assembly comprising an unloading rod and an unloading rod housing.

3. A conversion system as described in claim 2 and further including a shoulder stock assembly.

4. A conversion system as described in claim 2 and further including a scope mount assembly.

5. A 0.22 caliber long rifle removable conversion system kit for open top frame, black powder, ball and cap reproduction and replica revolver—recreation and gallery shooting, comprising two barrel sleeves including a first short barrel sleeve with a nut at one end and a lip at the other end and a second long barrel sleeve with a lip at one end and a spacer nut at the other end, the spacer nut being elongated having four slits and tapered thread at the end and a locking nut with a tapered inner thread being mated to the thread of the elongated nut.

6. A 0.22 caliber long rifle removable conversion system kit for open top frame, black powder, ball and cap reproduction and replica revolver—recreation and gallery shooting, comprising:

a black powder revolver having a barrel and a cylinder and a barrel wedge;

a doughnut shaped firing pin ring with a firing pin assembly and loading gate, with the cylinder and firing pin ring mated and sized to be received by the pistol to replace he existing black powder cylinder; and a barrel wedge to replace the existing barrel wedge of the pistol.

7. The system as set forth in claim 2 wherein the firing pin ring has a peripheral edge with a curved flat spring pivoted thereto, the spring having two threaded apertures with an adjusting screw and a locking screw within the apertures for providing a snugger fit of the firing pin ring assembly on the gun's frame.

8. A 0.22 caliber long rifle removable conversion kit for black powder, ball and cap reproduction and replica revolver—recreation and gallery shooting, comprising;

a barrel sleeve;

a barrel sleeve nut formed with a hook in combination with an unloading rod;

a firing pin ring assembly comprised of a loading gate subassembly, firing pin subassembly and firing pin ring, a cartridge cylinder being cylindrical in shape with cartridge apertures configured to mate with and engage the existing rotation hand and locking lug of the pistol frame; and a barrel wedge assembly comprising an expanding wedge subassembly and an unloading rod assembly comprising an unloading rod and an unloading rod housing.

9. The conversion kit as set forth in claim 8 adapted for use on a revolver with a pistol handle.

10. The conversion kit as set forth in claim 8 adapted for use on a revolver with a carbine stock.

11. The conversion system kit as set forth in claim 6 with the system further including an attachable shoulder stock to couple with the grip of the pistol without marring the finish and surface of the pistol.

12. The conversion system kit as set forth in claim 6 with the system further including a scope attachment to couple with pistol without marring the finish and surface of the pistol.

* * * * *